US009441851B2

(12) United States Patent
Motomura et al.

(10) Patent No.: US 9,441,851 B2
(45) Date of Patent: Sep. 13, 2016

(54) AIR-CONDITIONING APPARATUS

(75) Inventors: Yuji Motomura, Tokyo (JP); Koji Yamashita, Tokyo (JP); Osamu Morimoto, Tokyo (JP); Kosuke Tanaka, Tokyo (JP); Naofumi Takenaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 712 days.

(21) Appl. No.: 13/881,061

(22) PCT Filed: Dec. 9, 2010

(86) PCT No.: PCT/JP2010/007164

§ 371 (c)(1),
(2), (4) Date: Apr. 23, 2013

(87) PCT Pub. No.: WO2012/077166

PCT Pub. Date: Jun. 14, 2012

(65) Prior Publication Data

US 2013/0219937 A1 Aug. 29, 2013

(51) Int. Cl.
*F25B 41/00* (2006.01)
*F24F 11/02* (2006.01)
(Continued)

(52) U.S. Cl.
CPC ..... *F24F 11/02* (2013.01); *F25B 13/00* (2013.01); *F25B 25/005* (2013.01);
(Continued)

(58) Field of Classification Search
CPC .... F25B 47/006; F25B 13/00; F25B 25/005; F25B 2313/02322; F25B 2313/0232; F25B 2313/0314; F25B 2400/0409
USPC ..... 62/197; 165/104.14
See application file for complete search history.

(56) References Cited

U.S. PATENT DOCUMENTS 5,473,907 A * 12/1995 Briggs ..... F24D 5/12 62/238.7
5,671,607 A * 9/1997 Clemens ..... F04B 37/18 62/114

(Continued)

FOREIGN PATENT DOCUMENTS

JP 02-085656 A 3/1990
JP 05-172441 A 7/1993

(Continued)

OTHER PUBLICATIONS

International Search Report of the International Searching Authority mailed Jan. 7, 2011 for the corresponding international application No. PCT/JP2010/007164 (with English translation).

(Continued)

*Primary Examiner* — Allen Flanigan
*Assistant Examiner* — Kun Kai Ma
(74) *Attorney, Agent, or Firm* — Posz Law Group, PLC

(57) ABSTRACT

When using at least one of heat exchangers related to heat medium that exchange heat between a heat source side refrigerant and a heat medium as an evaporator, in a case where an air-conditioning apparatus has detected, in the heat exchanger related to heat medium that functions as the evaporator, an evaporating temperature of the heat source side refrigerant which causes the temperature of the heat medium passing through this heat exchanger related to heat medium to become equal to or lower than a freezing temperature, the air-conditioning apparatus performs a heat medium anti-freezing operation by blocking entry of the heat source side refrigerant into the heat exchanger related to heat medium that functions as the evaporator, and causing the heat source side refrigerant to flow to a bypass pipe.

6 Claims, 13 Drawing Sheets

(51) Int. Cl.
*F25B 13/00* (2006.01)
*F25B 25/00* (2006.01)
*F25B 47/00* (2006.01)

(52) U.S. Cl.
CPC ..... *F25B 47/006* (2013.01); *F25B 2313/006* (2013.01); *F25B 2313/0231* (2013.01); *F25B 2313/0232* (2013.01); *F25B 2313/0234* (2013.01); *F25B 2313/0272* (2013.01); *F25B 2313/02322* (2013.01); *F25B 2313/02331* (2013.01); *F25B 2313/02334* (2013.01); *F25B 2313/02732* (2013.01); *F25B 2313/02741* (2013.01); *F25B 2313/0314* (2013.01)

(56) References Cited

U.S. PATENT DOCUMENTS 6,430,951 B1 * 8/2002 Iritani ..... B60H 1/00021 62/160
2005/0061011 A1 * 3/2005 Yakumaru ..... B60H 1/00878 62/238.6
2005/0150243 A1 * 7/2005 Matsuoka ..... F25B 13/00 62/324.1
2007/0180851 A1 * 8/2007 Fujiyoshi ..... F24F 3/1411 62/480
2008/0282728 A1 * 11/2008 Takegami ..... F25B 1/10 62/498
2009/0007589 A1 * 1/2009 Takegami ..... F25B 13/00 62/498
2010/0101256 A1 * 4/2010 Kawano ..... F25B 13/00 62/324.6
2011/0088421 A1 * 4/2011 Wakamoto ..... F25B 13/00 62/238.7
2011/0113802 A1 * 5/2011 Wakamoto ..... F24F 3/06 62/196.1
2011/0146339 A1 * 6/2011 Yamashita ..... F24F 3/06 62/513
2011/0232308 A1 * 9/2011 Morimoto ..... F25B 13/00 165/287
2011/0315368 A1 * 12/2011 Azuma ..... F25B 13/00 165/287
2012/0031605 A1 * 2/2012 Takayama ..... F24F 11/008 165/201
2012/0042674 A1 * 2/2012 Takenaka ..... F24F 3/06 62/180
2012/0043054 A1 * 2/2012 Shimazu ..... F25B 13/00 165/58
2012/0043056 A1 * 2/2012 Shimazu ..... F24F 3/065 165/96
2012/0060551 A1 * 3/2012 Takayama ..... F25B 29/00 62/513

FOREIGN PATENT DOCUMENTS

JP 05-215437 A 8/1993
JP H05-280818 A 10/1993
JP 2000-088431 A 3/2000
JP 2001-289465 A 10/2001
JP 2003-343936 A 12/2003
JP 2005-016858 A 1/2005
JP 2005016858 A * 1/2005
JP 2005-140444 A 6/2005
JP 2005-164111 A 6/2005
JP 2005-315498 A 11/2005
JP WO 2009133640 A1 * 11/2009 ..... F25B 13/00
JP 2010-032167 A 2/2010
JP WO 2010050003 A1 * 5/2010 ..... F24F 3/06
JP WO 2010131378 A1 * 11/2010 ..... F24F 3/06
WO 2010/049998 A1 5/2010
WO 2010/109617 A1 9/2010
WO 2010/128553 A1 11/2010

OTHER PUBLICATIONS

Office Action mailed Mar. 18, 2014 issued in corresponding JP patent application No. 2012-547603 (and English translation).
Office Action mailed Feb. 9, 2015 issued in corresponding CN patent application No. 201080070316.8 (and English translation).
Office Action mailed Nov. 4, 2014 issued in corresponding JP patent application No. 2012-547603 (and English translation).
Extended European Search Report dated Apr. 11, 2014 issued in corresponding EP patent application No. 10860583.3.
Office Action dated Sep. 3, 2014 issued in corresponding CN patent application No. 201080070316.8 (with English translation).

* cited by examiner

AIR-CONDITIONING APPARATUS

CROSS REFERENCE TO RELATED APPLICATION

This application is a U.S. national stage application of PCT/JP2010/007164 filed on Dec. 9, 2010.

TECHNICAL FIELD

The present invention relates to an air-conditioning apparatus that is applied to, for example, a multi-air-conditioning apparatus for an office building.

BACKGROUND ART

In an air-conditioning apparatus in related-art, such as a multi-air-conditioning apparatus for an office building, a refrigerant is circulated, for example, between an outdoor unit, as a heat source unit disposed outside of a structure and an indoor unit disposed inside of the structure. The refrigerant transfers or removes heat in order to heat or cool air, thus heating or cooling a space to be conditioned with the heated or cooled air. As the refrigerant used in such an air-conditioning apparatus, for example, an HFC (hydrofluorocarbon) refrigerant is often used. An air-conditioning apparatus has also been developed which uses a natural refrigerant, such as carbon dioxide ($CO_2$).

In an air-conditioning apparatus called a chiller, cooling energy or heating energy is generated in a heat source unit disposed outside of a structure. Water, antifreeze, or the like is heated or cooled by a heat exchanger disposed in an outdoor unit, and conveyed to an indoor unit, such as a fan coil unit or a panel heater. And thereby, heating or cooling is performed (refer to Patent Literature 1, for example).

An air-conditioning apparatus called a heat recovery chiller is constituted such that a heat source unit is connected to each indoor unit by four water pipes arranged therebetween and, cooled water and heated water and the like are simultaneously supplied so that cooling or heating can be freely selected in indoor units (refer to Patent Literature 2, for example).

Further, an air-conditioning apparatus has been developed in which a heat exchanger for a primary refrigerant and a secondary refrigerant is disposed near each indoor unit to convey the secondary refrigerant to the indoor units (refer to Patent Literature 3, for example).

Furthermore, an air-conditioning apparatus has also been developed which is constituted such that an outdoor unit is connected to each branch unit including a heat exchanger by two pipes to convey a secondary refrigerant to an indoor unit (refer to Patent Literature 4, for example).

Moreover, air-conditioning apparatuses, such as a multi-air-conditioning apparatus for an office building, include an air-conditioning apparatus in which a refrigerant is circulated from an outdoor unit to a relay unit and a heat medium, such as water, is circulated from the relay unit to each indoor unit to reduce conveyance power for the heat medium while circulating the heat medium, such as water, through the indoor unit (refer to Patent Literature 5, for example).

CITATION LIST

Patent Literature

Patent Literature 1: Japanese Unexamined Patent Application Publication No. 2005-140444 (Page. 4, FIG. 1, for example)

Patent Literature 2: Japanese Unexamined Patent Application Publication No. 5-280818 (Pages. 4 and 5, FIG. 1, for example)

Patent Literature 3: Japanese Unexamined Patent Application Publication No. 2001-289465 (Pages. 5 to 8, FIGS. 1, and 2, for example)

Patent Literature 4: Japanese Unexamined Patent Application Publication No. 2003-343936 (Page. 5, FIG. 1)

Patent Literature 5: WO10/049,998 (Page 3, FIG. 1, for example)

SUMMARY OF INVENTION

Technical Problem

In an air-conditioning apparatus in related art, such as a multi-air-conditioning apparatus for an office building, a refrigerant may leak into, for example, an indoor space because the refrigerant is circulated up to an indoor unit. On the other hand, in an air-conditioning apparatus like those disclosed in Patent Literature 1 and Patent Literature 2, a refrigerant does not pass through an indoor unit. It is however necessary to heat or cool a heat medium in a heat source unit disposed outside of a structure and convey it to the indoor unit in the air-conditioning apparatus like those disclosed in Patent Literature 1 and Patent Literature 2. Accordingly, the circulation path for the heat medium becomes long. In this case, in conveying heat for predetermined heating or cooling using the heat medium, the amount of energy consumed as conveyance power and the like by the heat medium is higher than that by the refrigerant. As the circulation path becomes longer, therefore, the conveyance power markedly increases. This indicates that energy can be saved as long as the circulation of the heat medium can be properly controlled in the air-conditioning apparatus.

In the air-conditioning apparatus disclosed in Patent Literature 2, four pipes have to be connected between an outdoor side and indoor space so that cooling or heating can be selected in each indoor unit. Disadvantageously, it is not easy to install this apparatus. In the air-conditioning apparatus disclosed in Patent Literature 3, a secondary medium circulating means, such as a pump, has to be provided for each indoor unit. Disadvantageously, the system is costly and the noise is loud, therefore, this apparatus is not practical. In addition, since the heat exchanger is placed near each indoor unit, there always remains the risk that the refrigerant may leak into a place near the indoor space.

In the air-conditioning apparatus disclosed in Patent Literature 4, a primary refrigerant subjected to heat exchange flows into the same passage as that for the primary refrigerant to be subjected to heat exchange. In such a case, when a plurality of indoor units are connected, it is difficult for each indoor unit to exhibit a maximum capacity. Such a configuration wastes energy. Furthermore, each branch unit is connected to an extension pipe by two pipes for cooling and two pipes for heating, namely, four pipes in total. Consequently, this configuration is similar to that of a system in which the outdoor unit is connected to each branch unit by four pipes. Accordingly, it is not easy to install this apparatus.

Although the air-conditioning apparatus as described in Patent Literature 5 presents no problem in a case where a single refrigerant or a near-azeotropic refrigerant is used as the refrigerant, in a case where a zeotropic refrigerant mixture is used as the refrigerant, there is a risk that when using a refrigerant-heat medium heat exchanger as an evaporator, the heat medium such as water may result in freezing owing to the temperature gradient between the saturated liquid temperature and saturated gas temperature of the refrigerant.

The invention has been made to overcome the above problems and aims to provide an air-conditioning apparatus that is capable of saving energy and preventing the heat medium from freezing. The invention aims to provide an air-conditioning apparatus that can improve safety without circulating a refrigerant in or near an indoor unit. The invention aims to provide an air-conditioning apparatus that can reduce the number of connection pipes between an outdoor unit and a branch unit (heat medium relay unit) or an indoor unit to make the construction easier, and improve energy efficiency.

Solution to Problem

An air-conditioning apparatus according to the invention includes a refrigerant circuit that connects a compressor, a heat source side heat exchanger, a plurality of expansion devices, refrigerant side passages of a plurality of heat exchangers related to heat medium, and a plurality of refrigerant flow switching devices that switch a circulation path, by a refrigerant pipe to circulate a heat source side refrigerant, and a heat medium circuit that connects a pump, a use side heat exchanger, and heat medium side passages of the heat exchangers related to heat medium by a heat medium pipe to circulate a heat medium, and the heat exchangers related to heat medium exchange heat between the heat source side refrigerant and the heat medium. The refrigerant circuit is provided with a bypass pipe that bypasses the heat medium heat exchangers and returns the heat source side refrigerant to the compressor, and when using at least one of the heat exchangers related to heat medium as an evaporator, in a case where the air-conditioning apparatus has detected, in the heat exchanger related to heat medium that functions as the evaporator, an evaporating temperature of the heat source side refrigerant which causes a temperature of the heat medium passing through the heat exchanger related to heat medium to become equal to or lower than a freezing temperature, the air-conditioning apparatus performs a heat medium anti-freezing operation that blocks entry of the heat source side refrigerant into the heat exchanger related to heat medium that functions as the evaporator, and causes the heat source side refrigerant to flow via the bypass pipe.

Advantageous Effects of Invention

Since the air-conditioning apparatus according to the invention requires less conveyance power because pipes through which the heat medium circulates can be shortened, the apparatus can improve safety and save energy. In addition, even if the heat medium leaks to the outside of the air-conditioning apparatus according to the invention, the amount of the leakage can be kept small. Accordingly, the safety can be improved. Further, in accordance with the air-conditioning apparatus according to the invention, even when the temperature of the heat medium becomes equal to or lower than the freezing temperature in the heat exchanger related to heat medium, freezing of the heat medium can be efficiently prevented by switching the passage of the heat source side refrigerant flowing into the heat exchanger related to heat medium, thereby achieving further improvement of safety.

DESCRIPTION OF EMBODIMENT

Embodiments of the invention will be described below with reference to the drawings.

Figure 1:
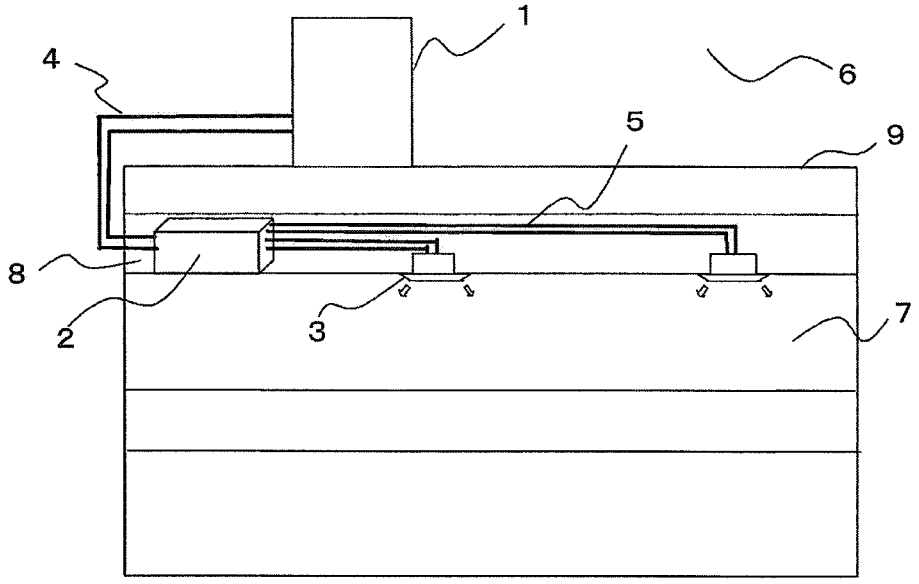
FIG. 1 is a schematic diagram illustrating an exemplary installation of an air-conditioning apparatus according to Embodiment of the invention.

FIG. 1 is a schematic diagram illustrating an exemplary installation of an air-conditioning apparatus according to Embodiment of the invention. The exemplary installation of the air-conditioning apparatus will be described with reference to FIG. 1. This air-conditioning apparatus employs refrigeration cycles (a refrigerant circuit A and a heat medium circuit B) in which refrigerants (a heat source side refrigerant or a heat medium) circulate such that a cooling mode or a heating mode can be freely selected as its operation mode in each indoor unit. FIG. 1 schematically illustrates the entire air-conditioning apparatus connected with a plurality of indoor units 3. Note that the dimensional relationship among components in FIG. 1 and the other figures may be different from the actual one.

Referring to FIG. 1, the air-conditioning apparatus according to Embodiment includes an outdoor unit 1 (heat source unit), a plurality of indoor units 3, and a relay unit 2 disposed between the outdoor unit 1 and the indoor units 3. The relay unit 2 exchanges heat between the heat source side refrigerant and the heat medium. The outdoor unit 1 and the relay unit 2 are connected with refrigerant pipes 4 thorough which the heat source side refrigerant is conveyed. The relay unit 2 and each indoor unit 3 are connected with pipes 5 (heat medium pipes) through which the heat medium is conveyed. Cooling energy or heating energy generated in the outdoor unit 1 is delivered through the relay unit 2 to the indoor units 3.

The outdoor unit 1 is typically disposed in an outdoor space 6 which is a space (e.g., a roof) outside of a structure 9, such as an office building, and is configured to supply cooling energy or heating energy through the relay unit 2 to the indoor units 3. Each indoor unit 3 is disposed at a position such that it can supply cooling air or heating air to an indoor space 7, which is a space (e.g., a living room) inside of the structure 9, and supplies air for cooling or air for heating to the indoor space 7 that is a space to be conditioned. The relay unit 2 is configured with a housing separated from housings of the outdoor unit 1 and the indoor units 3 such that the relay unit 2 can be disposed at a position different from those of the outdoor space 6 and the indoor space 7, and is connected to the outdoor unit 1 through the refrigerant pipes 4 and is connected to the indoor units 3 through the pipes 5 to transfer cooling energy or heating energy supplied from the outdoor unit 1 to the indoor units 3.

An operation of the air-conditioning apparatus according to Embodiment of the invention will be briefly described. The heat source side refrigerant is conveyed from the outdoor unit 1 to the relay unit 2 through the refrigerant pipes 4. The heat source side refrigerant that has been conveyed to the relay unit 2 exchanges heat with the heat medium in a heat exchanger related to heat medium (to be described later) in the relay unit 2 and heats or cools the heat medium. That is, hot water or cold water is produced in the heat exchanger related to heat medium. The hot water or cold water produced in the relay unit 2 is conveyed by a heat medium conveying device (to be described later) to the indoor unit 3 via the pipe 5, and used for the heating operation or the cooling operation for the indoor space 7 in the indoor unit 3.

As regards the heat source side refrigerant, a single refrigerant, such as R-22 or R-134a, a near-azeotropic refrigerant mixture, such as R-410A or R-404A, a non-azeotropic refrigerant mixture, such as R-407C, a refrigerant, such as $CF_3CF{=}CH_2$, containing a double bond in its chemical formula and having a relatively low global warming potential, a mixture containing the refrigerant, or a natural refrigerant, such as $CO_2$ or propane, can be used.

As regards the heat medium, for example, water, brine, a mixed solution of brine and water, or a mixed solution of water and an additive with high anticorrosive effect can be used.

As illustrated in FIG. 1, in the air-conditioning apparatus according to Embodiment, the outdoor unit 1 is connected to the relay unit 2 with two refrigerant pipes 4, and the relay unit 2 is connected to each indoor unit 3 with two pipes 5. As described above, in the air-conditioning apparatus according to Embodiment, each of the units (the outdoor unit 1, the indoor units 3, and the relay unit 2) is connected with two pipes (the refrigerant pipes 4 or the pipes 5), thus construction is facilitated.

Further, FIG. 1 illustrates a state where the relay unit 2 is disposed in the structure 9 but in a space different from the indoor space 7, for example, a space above a ceiling (hereinafter, simply referred to as a "space 8"). The relay unit 2 can be disposed in other spaces, such as a common space where an elevator or the like is installed. In addition, although FIG. 1 illustrates a case in which the indoor units 3 are of a ceiling cassette type, the indoor units are not limited to this type and, for example, a ceiling-concealed type, a ceiling-suspended type, or any type of indoor unit may be used as long as the unit can blow out heating air or cooling air into the indoor space 7 directly or through a duct or the like.

FIG. 1 illustrates a case in which the outdoor unit 1 is disposed in the outdoor space 6. The arrangement is not limited to this case. For example, the outdoor unit 1 may be disposed in an enclosed space, for example, a machine room with a ventilation opening, may be disposed inside of the structure 9 as long as waste heat can be exhausted through an exhaust duct to the outside of the structure 9, or may also be disposed inside of the structure 9 in the use of the outdoor unit 1 of a water-cooled type. Even when the outdoor unit 1 is disposed in such a place, no problem in particular will occur.

Furthermore, the relay unit 2 can be disposed near the outdoor unit 1. However, it should be noted that when the distance from the relay unit 2 to the indoor unit 3 is excessively long, because conveyance power for the heat medium becomes significantly large, the advantageous effect of energy saving is reduced. Additionally, the number of connected outdoor unit 1, indoor units 3, and relay unit 2 is not limited to those illustrated in FIG. 1. The number thereof can be determined in accordance with the structure 9 where the air-conditioning apparatus according to Embodiment is installed.

In a case where a plurality of relay units 2 are connected to a single outdoor unit 1, the plurality of relay units 2 can be installed so as to be dotted about a common use space or a space such as above a ceiling in a structure such as an office building. Accordingly, the air conditioning load can be provided by the heat exchanger related to heat medium within each relay unit 2. Moreover, it is possible to install the indoor unit 3 at a distance or height within the allowable conveying range of the heat medium conveying device within each relay unit 2, thereby allowing placement with respect to the entire structure such as an office building.

Figure 2:
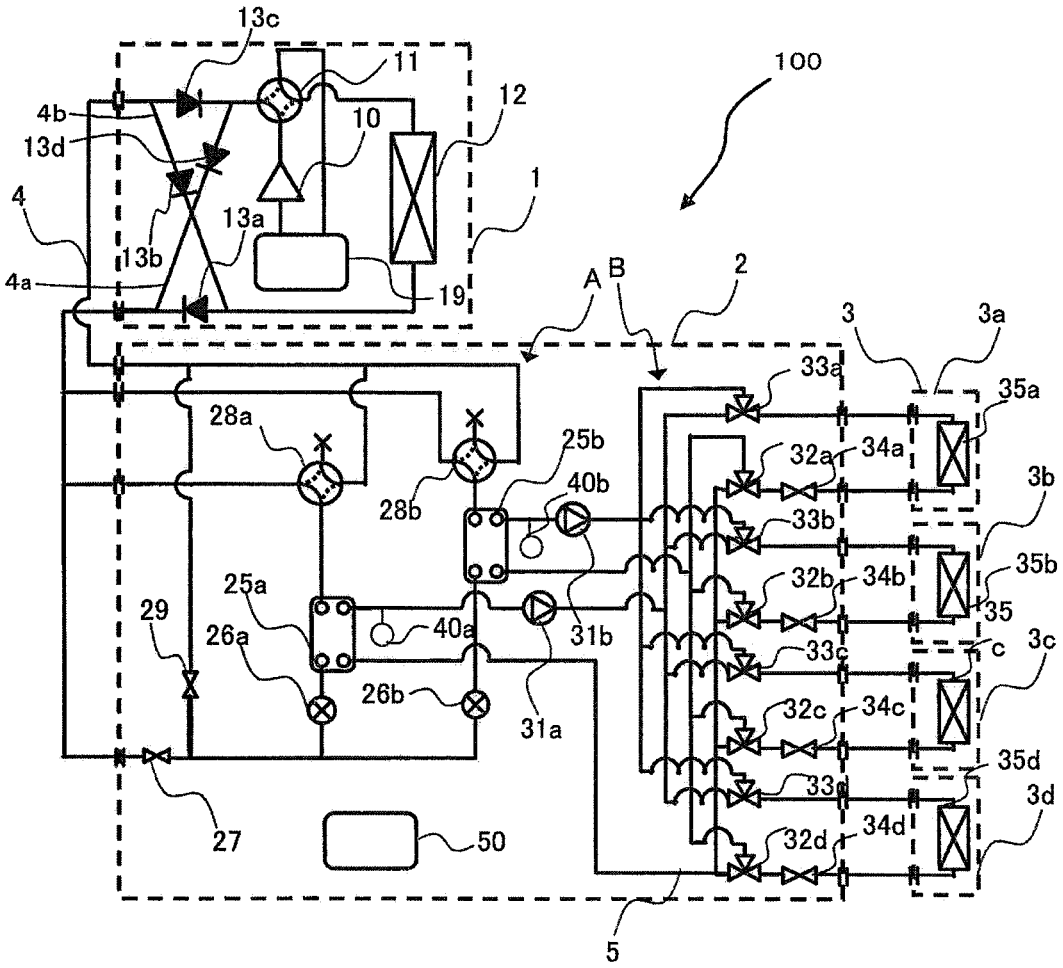
FIG. 2 is a schematic circuit diagram illustrating an exemplary circuit configuration of the air-conditioning apparatus according to Embodiment of the invention.

FIG. 2 is a schematic circuit diagram illustrating an exemplary circuit configuration of the air-conditioning apparatus (hereinafter, referred to as an "air-conditioning apparatus 100") according to Embodiment. The configuration of the air-conditioning apparatus 100, that is, the actions of individual actuators constituting the refrigerant circuit will be described in detail with reference to FIG. 2. As illustrated in FIG. 2, the outdoor unit 1 and the relay unit 2 are connected with the refrigerant pipes 4 through a heat exchanger 25*a* related to heat medium (refrigerant-water heat exchanger) and a heat exchanger 25*b* related to heat medium (refrigerant-water heat exchanger) included in the relay unit 2. Furthermore, the relay unit 2 and the indoor units 3 are connected with the pipes 5 through the heat exchangers 25*a* and 25*b* related to heat medium. Note that the refrigerant pipes 4 and the pipes 5 will be described in detail later.

[Outdoor Unit 1]

The outdoor unit 1 includes a compressor 10, a first refrigerant flow switching device 11 such as a four-way valve, a heat source side heat exchanger 12, and an accumulator 19 that are connected in series by the refrigerant pipes 4. The outdoor unit 1 further includes a refrigerant connection pipe 4*a*, a refrigerant connection pipe 4*b*, a check valve 13*a*, a check valve 13*b*, a check valve 13*c*, and a check valve 13*d*. The provision of the refrigerant connection pipe 4*a*, the refrigerant connection pipe 4*b*, the check valve 13*a*, the check valve 13*b*, the check valve 13*c*, and the check valve 13*d* allows the heat source side refrigerant, which is caused to flow into the relay unit 2, to flow in a constant direction irrespective of the operation required by the indoor unit 3.

The compressor 10 suctions in the heat source side refrigerant, compresses the heat source side refrigerant to a high temperature, high pressure state, and conveys the refrigerant to the refrigerant circuit A. The compressor 10 may include, for example, a capacity-controllable inverter compressor. The first refrigerant flow switching device 11 switches between the flow of the heat source side refrigerant in a heating operation (in a heating only operation mode and in a heating main operation mode (first heating main operation mode or second heating main operation mode)), and the flow of the heat source side refrigerant in a cooling operation (in a cooling only operation mode (first cooling only operation mode or second cooling only operation mode)) and in a cooling main operation mode (first cooling main operation mode or second cooling main operation mode)).

The heat source side heat exchanger 12 is configured to function as an evaporator in the heating operation, function as a condenser (or a radiator) in the cooling operation, exchange heat between a fluid of air, supplied from an unillustrated air-sending device such as a fan, and the heat source side refrigerant, and evaporate and gasify or condense and liquefy the heat source side refrigerant. The accumulator 19 is disposed on a suction side of the compressor 10 and is configured to store an excess refrigerant caused by the difference between the heating operation and the cooling operation or by transient change in operation.

The check valve 13*c* is provided in the refrigerant pipe 4 between the relay unit 2 and the first refrigerant flow switching device 11 and permits the heat source side refrigerant to flow only in a predetermined direction (the direction from the relay unit 2 to the outdoor unit 1). The check valve 13*a* is provided in the refrigerant pipe 4 between the heat source side heat exchanger 12 and the relay unit 2 and permits the heat source side refrigerant to flow only in a predetermined direction (the direction from the outdoor unit 1 to the relay unit 2). The check valve 13*d* is provided in the refrigerant connection pipe 4*a* and allows the heat source side refrigerant discharged from the compressor 10 to flow through the relay unit 2 during the heating operation. The check valve 13*b* is disposed in the refrigerant connection pipe 4*b* and allows the heat source side refrigerant, returning from the relay unit 2 to flow to the suction side of the compressor 10 during the heating operation.

The refrigerant connection pipe 4*a* connects the refrigerant pipe 4, between the first refrigerant flow switching device 11 and the check valve 13*c*, to the refrigerant pipe 4, between the check valve 13*a* and the relay unit 2, in the relay unit 2. The refrigerant connection pipe 4*b* is configured to connect the refrigerant pipe 4, between the check valve 13*c* and the relay unit 2, to the refrigerant pipe 4, between the heat source side heat exchanger 12 and the check valve 13*a*, in the outdoor unit 1. It should be noted that FIG. 2 illustrates a case where the refrigerant connection pipe 4*a*, the refrigerant connection pipe 4*b*, the check valve 13*a*, the check valve 13*b*, the check valve 13*c*, and the check valve 13*d* are arranged, but the arrangement is not limited to this case. It is not necessarily required to arrange these components.

[Indoor Units 3]

The indoor units 3 each include a use side heat exchanger 35. Each of the use side heat exchanger 35 is connected to a heat medium flow control device 34 and a second heat medium flow switching device 33 in the relay unit 2 with the pipes 5. The use side heat exchanger 35 is configured to exchange heat between air supplied from an unillustrated air-sending device, such as a fan, and the heat medium in order to generate heating air or cooling air to be supplied to the indoor space 7.

FIG. 2 illustrates a case in which four indoor units 3 are connected to the relay unit 2. Illustrated are, from the top of the drawing, an indoor unit 3*a*, an indoor unit 3*b*, an indoor unit 3*c*, and an indoor unit 3*d*. In addition, the use side heat exchangers 35 are illustrated as, from the top of the drawing, a use side heat exchanger 35*a*, a use side heat exchanger 35*b*, a use side heat exchanger 35*c*, and a use side heat exchanger 35*d* each corresponding to the indoor units 3*a* to 3*d*. As is the case of FIG. 1, the number of connected indoor units 3 illustrated in FIG. 2 is not limited to four.

[Relay Unit 2]

The relay unit 2 includes the two or more heat exchangers 25 related to heat medium, two expansion devices 26, two opening and closing devices (opening and closing device 27 and opening and closing device 29), two second refrigerant flow switching devices 28, two pumps 31, four first heat medium flow switching devices 32, the four second heat medium flow switching devices 33, and the four heat medium flow control devices 34.

Each of the two heat exchangers 25 related to heat medium (heat exchanger 25*a* related to heat medium and heat exchanger 25*b* related to heat medium) functions as a condenser (radiator) when supplying the heating energy to an indoor unit 3 performing the heating operation and functions as an evaporator when supplying the cooling energy to an indoor unit 3 performing the cooling operation, exchanges heat between the heat source side refrigerant and the heat medium, and conveys the cooling energy or heating energy that has been generated in the outdoor unit 1 and that is stored in the heat source side refrigerant to the heat medium. The heat exchanger 25*a* related to heat medium is disposed between an expansion device 26*a* and a second refrigerant flow switching device 28*a* in the refrigerant circuit A and is used to cool the heat medium in the cooling and heating mixed operation mode. Furthermore, the heat exchanger 25*b* related to heat medium is disposed between an expansion device 26*b* and a second refrigerant flow switching device 28*b* in the refrigerant circuit A and is used to heat the heat medium in the cooling and heating mixed operation mode.

The two expansion devices 26 (the expansion device 26*a* and the expansion device 26*b*) each have functions as a reducing valve and an expansion valve and are configured to decompress and expand the heat source side refrigerant. The expansion device 26*a* is disposed upstream from the heat exchanger 25*a* related to heat medium in the flow direction of the heat source side refrigerant during the cooling operation. The expansion device 26*b* is disposed upstream from the heat exchanger 25*b* related to heat medium in the flow direction of the heat source side refrigerant during the cooling operation. Each of the two expansion devices 26 may include a component having a variably controllable opening degree, for example, an electronic expansion valve.

The two opening and closing devices (the opening and closing device 27 and the opening and closing device 29) each include a solenoid valve or the like which can be operated to open and close when energized, and are configured to open and close the refrigerant pipe 4. That is, the opening and closing of the two opening and closing devices are controlled in accordance with the operation mode, thereby switching the passage of the heat source side refrigerant. The opening and closing device 27 is provided on the inlet side of the heat source side refrigerant in the refrigerant pipe 4 (the refrigerant pipe 4 located in the lowermost portion in the plane of the drawing of the refrigerant pipe 4 that connects the outdoor unit 1 and the relay unit 2). The opening and closing device 29 is provided in a pipe (a bypass pipe 20) that connects the inlet side of the heat source side refrigerant of the refrigerant pipe 4 and the outlet side of the refrigerant pipe 4. The opening and closing device 27 and the opening and closing device 29 each may include any device that can switch the passage of the refrigerant. For example, a device whose opening degree can be variably controlled such as an electronic expansion valve may be used.

The two second refrigerant flow switching devices 28 (the second refrigerant flow switching device 28*a* and the second refrigerant flow switching device 28*b*) each include, for example, a four-way valve, and switches the flow of the heat source side refrigerant so as to allow the corresponding heat exchanger 25 related to heat medium to function as a condenser or an evaporator according to the operation mode. The second refrigerant flow switching device 28*a* is disposed downstream from the heat exchanger 25*a* related to heat medium in the flow direction of the heat source side refrigerant during the cooling operation. The second refrigerant flow switching device 28*b* is disposed downstream from the heat exchanger 25*b* related to heat medium in the flow direction of the heat source side refrigerant during the cooling only operation mode.

The two pumps 31 (a pump 31*a* and a pump 31*b*) are configured to circulate the heat medium conveyed through the pipes 5 in heat medium circuits B. The pump 31*a* is disposed in the pipe 5 positioned between heat exchanger 25*a* related to heat medium and the second heat medium flow switching devices 33. The pump 31*b* is disposed in the pipe 5 positioned between the heat exchanger 25*b* related to heat medium and the second heat medium flow switching devices 33. The two pumps 31 each include, for example, a capacity-controllable pump and may be one capable of controlling the flow rate according to the load in the indoor units 3.

The four first heat medium flow switching devices 32 (first heat medium flow switching devices 32*a* to 32*d*) each include, for example, a three-way valve and switches passages of the heat medium between the heat exchanger 25*a* related to heat medium and the heat exchanger 25*b* related to heat medium. Note that the first heat medium flow switching devices 32 are arranged so that the number thereof (four in this case) corresponds to the installed number of indoor units 3. Each first heat medium flow switching device 32 is disposed on an outlet side of a heat medium passage of the corresponding use side heat exchanger 35 such that one of the three ways is connected to the heat exchanger 25*a* related to heat medium, another one of the three ways is connected to the heat exchanger 25*b* related to heat medium, and the other one of the three ways is connected to the corresponding heat medium flow control device 34. Illustrated from the top of the drawing are the first heat medium flow switching device 32*a*, the first heat medium flow switching device 32*b*, the first heat medium flow switching device 32*c*, and the first heat medium flow switching device 32*d*, so as to correspond to the respective indoor units 3. Furthermore, switching of the heat medium passage includes not only complete switching from one to the other but also partial switching from one to another.

The four second heat medium flow switching devices 33 (second heat medium flow switching devices 33*a* to 33*d*) each include, for example, a three-way valve and switches the passage of the heat medium between the heat exchanger 25*a* related to heat medium and the heat exchanger 25*b* related to heat medium. Note that the second heat medium flow switching devices 33 are arranged so that the number thereof (four in this case) corresponds to the installed number of indoor units 3. Each second heat medium flow switching device 33 is disposed on an inlet side of the heat medium passage of the corresponding use side heat exchanger 35 such that one of the three ways is connected to the heat exchanger 25*a* related to heat medium, another one of the three ways is connected to the heat exchanger 25*b* related to heat medium, and the other one of the three ways is connected to the corresponding use side heat exchanger 35. Illustrated from the top of the drawing are the second heat medium flow switching device 33*a*, the second heat medium flow switching device 33*b*, the second heat medium flow switching device 33*c*, and the second heat medium flow switching device 33*d*, so as to correspond to the respective indoor units 3. Furthermore, switching of the heat medium passage includes not only complete switching from one to the other but also partial switching from one to another.

The four heat medium flow control devices 34 (heat medium flow control devices 34*a* to 34*d*) each include, for example, a two-way valve capable of controlling the area of opening and control the flow rate of the heat medium flowing in the pipe 5. Note that the heat medium flow control devices 34 are arranged so that the number thereof (four in this case) corresponds to the installed number of indoor units 3. Each heat medium flow control device 34 is disposed on the outlet side of the heat medium passage of the corresponding use side heat exchanger 35 such that one way is connected to the use side heat exchanger 35 and the other way is connected to the first heat medium flow switching device 32. That is, each heat medium flow control device 34 controls the amount of heat medium flowing into the corresponding indoor unit 3 by the temperature of the heat medium flowing into and the temperature of the heat medium flowing out of the indoor unit 3, and thus is capable of supplying the optimum amount of heat medium to the indoor unit 3 in relation to the indoor load.

Furthermore, illustrated from the top of the drawing are the heat medium flow control device 34*a*, the heat medium flow control device 34*b*, the heat medium flow control device 34*c*, and the heat medium flow control device 34*d* so as to correspond to the respective indoor units 3. In addition, each of the heat medium flow control devices 34 may be disposed on the inlet side of the heat medium passage of the corresponding use side heat exchanger 35. Furthermore, the heat medium flow control device 34 may be disposed on the inlet side of the heat medium passage of the use side heat exchanger 35 such that the heat medium flow control device 34 is positioned between the second heat medium flow switching device 33 and the use side heat exchanger 35. Further, in the indoor units 3, during suspension, thermo-off, or the like, when no load is demanded, the heat medium flow control devices 34 may be fully closed and the supply of the heat medium to the indoor units 3 may be stopped.

When the first heat medium flow switching device 32 or the second heat medium flow switching device 33 that is added with the function of the heat medium flow control device 34 is used, it is possible to omit the heat medium flow control device 34.

The relay unit 2 is provided with temperature sensors 40 (a temperature sensor 40*a* and a temperature sensor 40*b*) for detecting the temperature of the heat medium on the outlet side of the heat exchangers 25 related to heat medium. Information (temperature information) detected by these temperature sensors 40 are transmitted to a controller 50 that performs integrated control of the operation of the air-conditioning apparatus 100 such that the information is used to control, for example, the driving frequency of the compressor 10, the rotation speed of the unillustrated air-sending device, switching of the first refrigerant flow switching device 11, the driving frequency of the pumps 31, switching of the second refrigerant flow switching devices 28, switching of passages of the heat medium, and the control of the flow rate of the heat medium of the indoor units 3. While a state in which the controller 50 is included in the relay unit 2 is illustrated by way of example, this is not intended to be limitative. The controller 50 may be included in the outdoor unit 1 or the indoor unit 3, or in each individual unit in a manner that allows communication.

The controller 50 is configured by a microcomputer or the like. The controller 50 executes various operation modes described later by controlling individual actuators (driving parts such as the pumps 31, the first heat medium flow switching devices 32, the second heat medium flow switching devices 33, the expansion devices 26, and the second refrigerant flow switching devices 28), such as the driving frequency of the compressor 10, the rotation speed (including ON/OFF) of the air-sending device, switching of the first refrigerant flow switching device 11, driving of the pumps 31, the opening degree of the expansion devices 26, opening and closing of the opening and closing devices, switching of the second refrigerant flow switching devices 28, switching of the first heat medium flow switching devices 32, switching of the second heat medium flow switching devices 33, driving of the heat medium flow control devices 34, on the basis of the information detected by various detection means and instructions from a remote control.

The pipes 5 in which the heat medium flows include the pipes connected to the heat exchanger 25*a* related to heat medium and the pipes connected to the heat exchanger 25*b* related to heat medium. Each pipe 5 is branched (into four in this case) in accordance with the number of indoor units 3 connected to the relay unit 2. The pipes 5 are connected with the first heat medium flow switching devices 32 and the second heat medium flow switching devices 33. Controlling the first heat medium flow switching devices 32 and the second heat medium flow switching devices 33 determines whether the heat medium flowing from the heat exchanger 25*a* related to heat medium is allowed to flow into the use side heat exchanger 35 or whether the heat medium flowing from the heat exchanger 25*b* related to heat medium is allowed to flow into the use side heat exchanger 35.

In the air-conditioning apparatus 100, the compressor 10, the first refrigerant flow switching device 11, the heat source side heat exchanger 12, the opening and closing device 27, the opening and closing device 29, the second refrigerant flow switching devices 28, the refrigerant passages of the heat exchangers 25 related to heat medium, the expansion devices 26, and the accumulator 19 are connected through the refrigerant pipe 4, thus forming the refrigerant circuit A. In addition, the heat medium passages of the heat exchangers 25 related to heat medium, the pumps 31, the first heat medium flow switching devices 32, the heat medium flow control devices 34, the use side heat exchangers 35, and the second heat medium flow switching devices 33 are connected by the pipes 5, thus forming the heat medium circuits B. In other words, the plurality of use side heat exchangers 35 are connected in parallel to each of the heat exchangers 25 related to heat medium, thus turning the heat medium circuits B into a multi-system.

Accordingly, in the air-conditioning apparatus 100, the outdoor unit 1 and the relay unit 2 are connected through the heat exchanger 25*a* related to heat medium and the heat exchanger 25*b* related to heat medium arranged in the relay unit 2. The relay unit 2 and the indoor units 3 are connected through the heat exchanger 25*a* related to heat medium and the heat exchanger 25*b* related to heat medium. In other words, in the air-conditioning apparatus 100, the heat exchanger 25*a* related to heat medium and the heat exchanger 25*b* related to heat medium each exchange heat between the heat source side refrigerant circulating in the refrigerant circuit A and the heat medium circulating in the heat medium circuits B. By utilizing the above configuration, the air-conditioning apparatus 100 is capable of performing the optimum cooling operation or heating operation in accordance with the indoor load.

[Operation Modes]

Various operation modes carried out by the air-conditioning apparatus 100 will be described below. The air-conditioning apparatus 100 allows each indoor unit 3, on the basis of an instruction from the indoor unit 3, to perform a cooling operation or a heating operation. Specifically, the air-conditioning apparatus 100 may allow all of the indoor units 3 to perform the same operation and also allow each of the indoor units 3 to perform different operations.

The operation modes carried out by the air-conditioning apparatus 100 include the cooling only operation mode in which all of the operating indoor units 3 perform the cooling operation, the heating only operation mode in which all of the operating indoor units 3 perform the heating operation, the cooling main operation mode of the cooling and heating mixed operation mode in which a cooling load is larger than a heating load, and the heating main operation mode of the cooling and heating mixed operation mode in which a heating load is larger than a cooling load. The operation modes will be described below with respect to the flow of the heat source side refrigerant and that of the heat medium.

[Heating Only Operation Mode]

Figure 3:
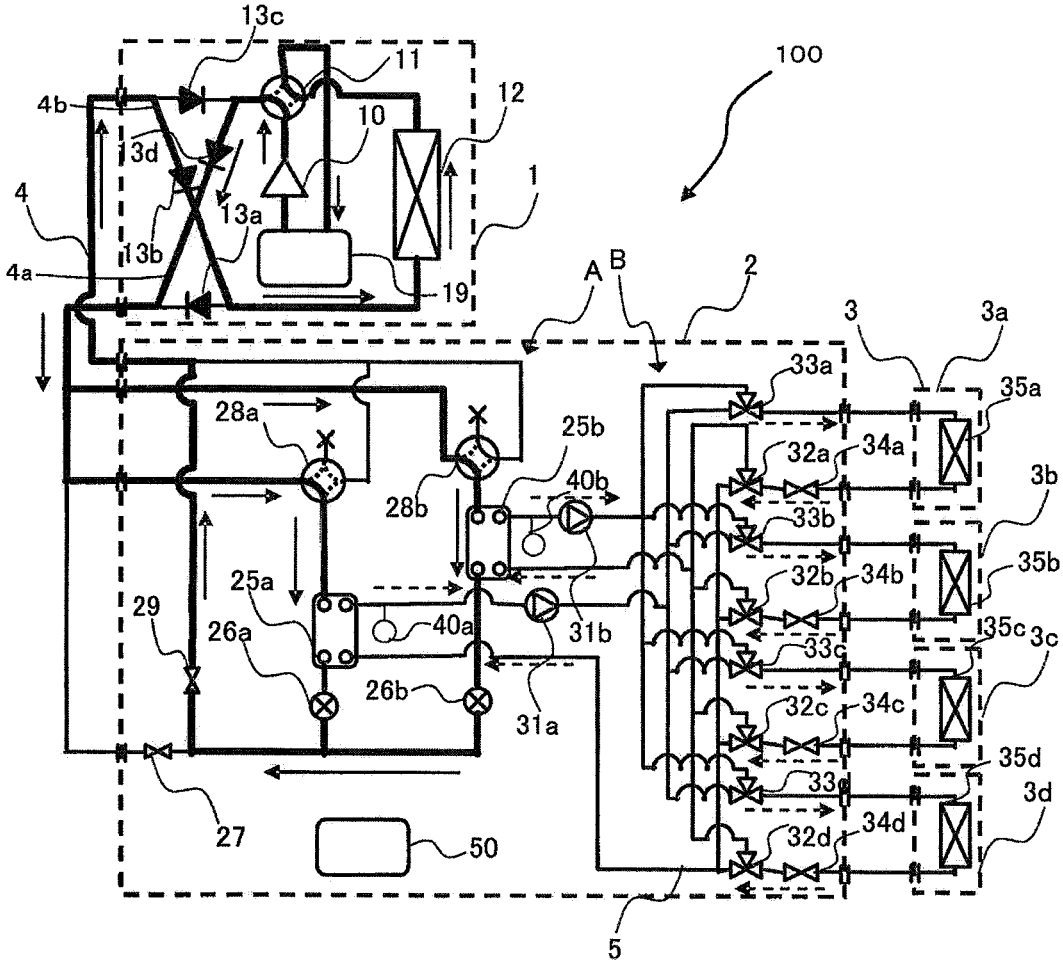
FIG. 3 is a refrigerant circuit diagram illustrating a flow of a refrigerant in a heating only operation mode of the air-conditioning apparatus according to Embodiment of the invention.

FIG. 3 is a refrigerant circuit diagram illustrating the flow of the refrigerant in the heating only operation mode of the air-conditioning apparatus 100. In FIG. 3, the heating only operation mode will be described with respect to a case where a heating load is generated in all of the use side heat exchangers 35*a* to 35*d*. Further, referring to FIG. 3, pipes indicated by thick lines indicate the pipes through which the heat source side refrigerant flows. Furthermore, referring to FIG. 3, solid-line arrows indicate the flow direction of the heat source side refrigerant and broken-line arrows indicate the flow direction of the heat medium.

In the heating only operation mode illustrated in FIG. 3, the first refrigerant flow switching device 11 is switched such that the heat source side refrigerant discharged from the compressor 10 flows into the relay unit 2 without passing through the heat source side heat exchanger 12 in the outdoor unit 1. In the relay unit 2, the pump 31*a* and the pump 31*b* are driven, and the heat medium flow control devices 34*a* to 34*d* are opened, so that the heat medium circulates between each of the heat exchanger 25*a* related to heat medium and the heat exchanger 25*b* related to heat medium, and each of the use side heat exchangers 35*a* to 35*d*. The second refrigerant flow switching device 28*a* and the second refrigerant flow switching device 28*b* are switched to the heating side, the opening and closing device 27 is closed, and the opening and closing device 29 is open.

First, the flow of the heat source side refrigerant in the refrigerant circuit A will be described.

A low temperature, low pressure refrigerant is compressed by the compressor 10 and is discharged as a high temperature, high pressure gas refrigerant therefrom. The high temperature, high pressure gas refrigerant discharged from the compressor 10 passes through the first refrigerant flow switching device 11, flows through the refrigerant connection pipe 4*a*, passes through the check valve 13*d*, and flows out of the outdoor unit 1. The high temperature, high pressure gas refrigerant that has flowed out of the outdoor unit 1 passes through the refrigerant pipe 4 and flows into the relay unit 2. The high temperature, high pressure gas refrigerant that has flowed into the relay unit 2 is branched, passes through each of the second refrigerant flow switching device 28*a* and the second refrigerant flow switching device 28*b*, and flows into the corresponding one of the heat exchanger 25*a* related to heat medium and the heat exchanger 25*b* related to heat medium.

The high temperature, high pressure gas refrigerant that has flowed into each of the heat exchanger 25*a* related to heat medium and the heat exchanger 25*b* related to heat medium is condensed and liquefied into a high pressure liquid refrigerant while transferring heat to the heat medium circulating in the heat medium circuits B. The liquid refrigerant which has flowed out of the heat exchanger 25*a* related to heat medium and that flowing out of the heat exchanger 25*b* related to heat medium are expanded into a low temperature, low pressure two-phase refrigerant in the expansion device 26*a* and the expansion device 26*b*. This two-phase refrigerant, after the flows thereof are merged, passes through the opening and closing device 29, flows out of the relay unit 2, passes through the refrigerant pipe 4, and again flows into the outdoor unit 1. The refrigerant that has flowed into the outdoor unit 1 flows through the refrigerant connection pipe 4*b*, passes through the check valve 13*b*, and flows into the heat source side heat exchanger 12 functioning as an evaporator.

Then, the refrigerant which has flowed into the heat source side heat exchanger 12 removes heat from the air in the outdoor space 6 (hereinafter, referred to as outdoor air) in the heat source side heat exchanger 12 and thus turns into a low temperature, low pressure gas refrigerant. The low temperature, low pressure gas refrigerant which has flowed out of the heat source side heat exchanger 12 passes through the first refrigerant flow switching device 11 and the accumulator 19 and is suctioned into the compressor 10 again.

At this time, the opening degree of the expansion device 26 is controlled so that the subcooling (degree of subcooling) obtained as the difference between a value of the saturation temperature converted from the pressure of the heat source side refrigerant flowing between the heat exchanger 25 related to heat medium and the expansion device 26, and the temperature on the outlet side of the heat exchanger 25 related to heat medium becomes constant. Note that when a temperature at the middle position of the heat exchangers 25 related to heat medium can be measured, the temperature at the middle position may be used instead of the converted saturation temperature. In this case, it is unnecessary to install the pressure sensor, thus the system can be established inexpensively.

Next, the flow of the heat medium in the heat medium circuits B will be described.

In the heating only operation mode, both of the heat exchanger 25*a* related to heat medium and the heat exchanger 25*b* related to heat medium transfer heating energy of the heat source side refrigerant to the heat medium and the pump 31*a* and the pump 31*b* allow the heated heat medium to flow through the pipes 5. The heat medium, which has flowed out of each of the pump 31*a* and the pump 31*b* while being pressurized, flows through the second heat medium flow switching devices 33*a* to 33*d* into the use side heat exchangers 35*a* to 35*d*. Then the heat medium transfers heat to the indoor air in the use side heat exchangers 35*a* to 35*d*, thus heats the indoor space 7.

Then, the heat medium flows out of each of the use side heat exchangers 35*a* to 35*d* and flows into the corresponding one of the heat medium flow control devices 34*a* to 34*d*. At this time, each of the heat medium flow control devices 34*a* to 34*d* controls a flow rate of the heat medium as necessary to cover an air conditioning load required in the indoor space such that the controlled flow rate of the heat medium flows into the corresponding one of the use side heat exchangers 35*a* to 35*d*. The heat medium that has flowed out of the heat medium flow control devices 34*a* to 34*d*, passes through the first heat medium flow switching devices 32*a* to 32*d*, flows into the heat exchanger 25*a* related to heat medium and the heat exchanger 25*b* related to heat medium, receives the quantity of heat amounting to the quantity of heat that had been supplied to the indoor space 7 through the indoor units 3 from the refrigerant, and is again suctioned into the pump 31*a* and the pump 31*b*.

Note that in the pipes 5 of each use side heat exchanger 35, the heat medium is directed to flow from the second heat medium flow switching device 33 through the heat medium flow control device 34 to the first heat medium flow switching device 32. The air conditioning load required in the indoor space 7 can be provided by controlling the difference between the temperature detected by the temperature sensor 40*a* or the temperature detected by the temperature sensor 40*b* and the temperature of the heat medium that has flowed out of the use side heat exchanger 35 so as to maintain the difference at a target value. As regards a temperature at the outlet of each heat exchanger 25 related to heat medium, either of the temperature detected by the temperature sensor 40*a* or that detected by the temperature sensor 40*b* may be used. Alternatively, the mean temperature of the two may be used.

At this time, the first heat medium flow switching device 32 and the second heat medium flow switching device 33 are controlled to an intermediate opening degree, or an opening degree in accordance with the heat medium temperature at the outlet of the heat exchanger 25*a* related to heat medium and the heat exchanger 25*b* related to heat medium, so as to secure passages leading to both the heat exchanger 25*a* related to heat medium and the heat exchanger 25*b* related to heat medium. Although the use side heat exchanger 35 should essentially be controlled on the basis of the difference between a temperature at its inlet and that at its outlet, since the temperature of the heat medium on the inlet side of the use side heat exchanger 35 is substantially the same as that detected by the temperature sensor 40*b*, the use of the temperature sensor 40*b* can reduce the number of temperature sensors, so that the system can be constructed inexpensively.

Upon executing the heating only operation mode, since it is unnecessary to supply the heat medium to each use side heat exchanger 35 having no heat load (including thermo-off state), the passage is closed by the corresponding heat medium flow control device 34 such that the heat medium does not flow into the use side heat exchanger 35. In FIG. 3, the heat medium is passed in all of the use side heat exchangers 35*a* to 35*d* because a heat load exists therein. When a heat load ceases to exist, the corresponding heat medium flow control device 34 may be fully closed. Then, when a heat load is generated again, the corresponding heat medium flow control device 34 may be opened to circulate the heat medium. In this regard, the same applies to other operation modes described later.

[First Heating Main Operation Mode]

Figure 4:
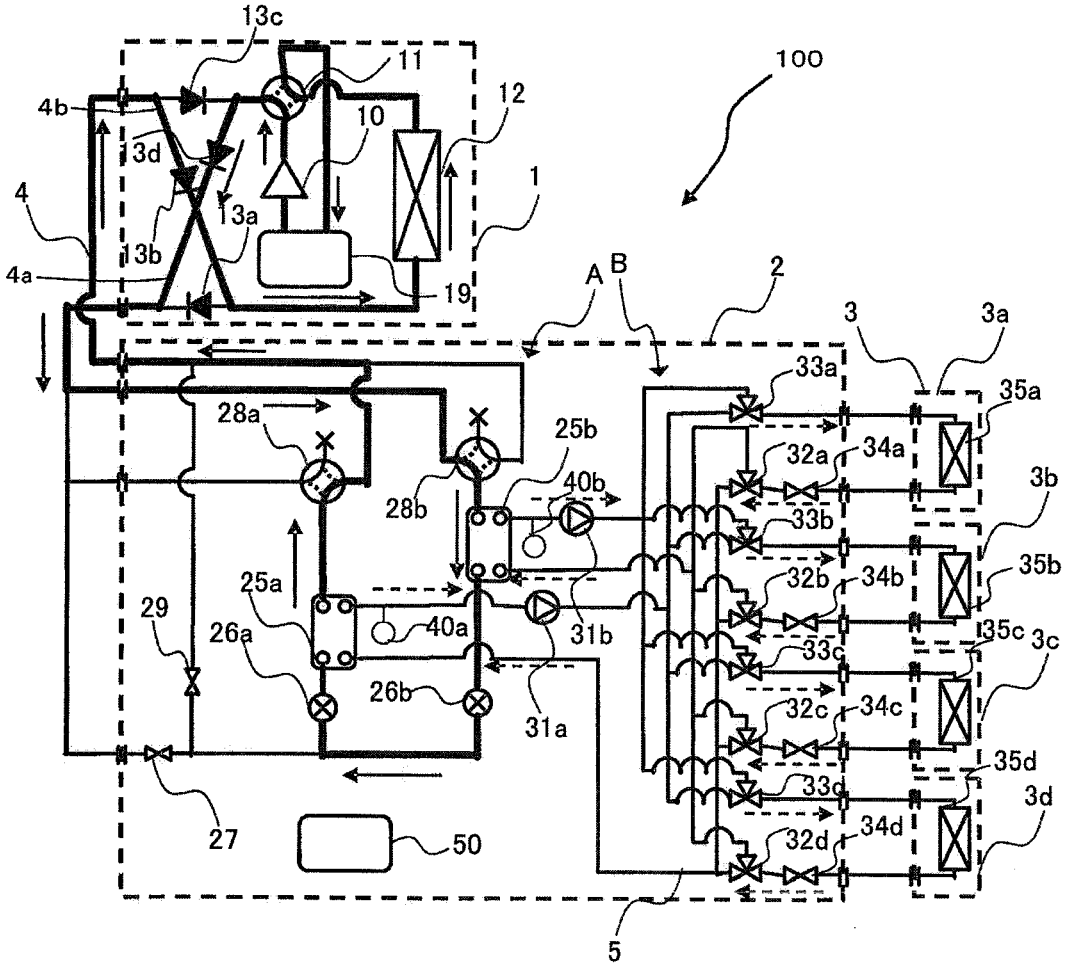
FIG. 4 is a refrigerant circuit diagram illustrating a flow of the refrigerant in a first heating main operation mode of the air-conditioning apparatus according to Embodiment of the invention.

FIG. 4 is a refrigerant circuit diagram illustrating the flow of the refrigerant in the first heating main operation mode of the air-conditioning apparatus 100. In FIG. 4, the first heating main operation mode will be described with respect to a case where a heating load is generated in at least one of the use side heat exchangers 35, and a cooling load is generated in the rest of the use side heat exchangers 35 by way of example. Further, referring to FIG. 4, pipes indicated by thick lines indicate the pipes through which the heat source side refrigerant circulates. Furthermore, referring to FIG. 4, solid-line arrows indicate the flow direction of the heat source side refrigerant and broken-line arrows indicate the flow direction of the heat medium.

In the first heating main operation mode illustrated in FIG. 4, the first refrigerant flow switching device 11 is switched such that the heat source side refrigerant discharged from the compressor 10 flows into the relay unit 2 without passing through the heat source side heat exchanger 12 in the outdoor unit 1. In the relay unit 2, the pump 31*a* and the pump 31*b* are driven, and the heat medium flow control devices 34*a* to 34*d* are opened, so that the heat medium circulates between the heat exchanger 25*a* related to heat medium and the use side heat exchanger 35 in which a cooling load is generated, and between the heat exchanger 25*b* related to heat medium and the use side heat exchanger 35 in which a heating load is generated. The second refrigerant flow switching device 28*a* is switched to the cooling side, the second refrigerant flow switching device 28*b* is switched to the heating side, the expansion device 26*a* is fully open, the opening and closing device 27 is closed, and the opening and closing device 29 is closed.

First, the flow of the heat source side refrigerant in the refrigerant circuit A will be described.

A low temperature, low pressure refrigerant is compressed by the compressor 10 and is discharged as a high temperature, high pressure gas refrigerant therefrom. The high temperature, high pressure gas refrigerant discharged from the compressor 10 passes through the first refrigerant flow switching device 11, flows through the refrigerant connection pipe 4*a*, passes through the check valve 13*d*, and flows out of the outdoor unit 1. The high temperature, high pressure gas refrigerant that has flowed out of the outdoor unit 1 passes through the refrigerant pipe 4 and flows into the relay unit 2. The high temperature, high pressure gas refrigerant that has flowed into the relay unit 2 passes through the second refrigerant flow switching device 28*b* and flows into the heat exchanger 25*b* related to heat medium functioning as a condenser.

The gas refrigerant that has flowed into the heat exchanger 25*b* related to heat medium is condensed and liquefied while transferring heat to the heat medium circulating in the heat medium circuits B, and turns into a liquid refrigerant. The liquid refrigerant which has flowed from the heat exchanger 25*b* related to heat medium is expanded into a low pressure two-phase refrigerant by the expansion device 26*b*. This low pressure two-phase refrigerant flows through the expansion device 26*a* and into the heat exchanger 25*a* related to heat medium functioning as an evaporator. The low pressure two-phase refrigerant that has flowed into the heat exchanger 25*a* related to heat medium removes heat from the heat medium circulating in the heat medium circuits B, is evaporated, and cools the heat medium. This low pressure two-phase refrigerant flows out of the heat exchanger 25*a* related to heat medium, passes through the second refrigerant flow switching device 28*a*, flows out of the relay unit 2, passes through the refrigerant pipe 4, and again flows into the outdoor unit 1.

The low temperature, low pressure refrigerant that has flowed into the outdoor unit 1 passes through the check valve 13*b* and flows into the heat source side heat exchanger 12 functioning as an evaporator. The refrigerant, which has flowed into the heat source side heat exchanger 12, removes heat from the outdoor air in the heat source side heat exchanger 12, such that it turns into a low temperature, low pressure gas refrigerant. The low temperature, low pressure gas refrigerant which has flowed out of the heat source side heat exchanger 12 passes through the first refrigerant flow switching device 11 and the accumulator 19 and is suctioned into the compressor 10 again.

The opening degree of the expansion device 26*b* is controlled so that the subcooling (degree of subcooling) of the refrigerant in the outlet of the heat exchanger 25*b* related to heat medium becomes a predetermined target value. Note that, the expansion device 26*b* may be fully opened and the expansion device 26*a* may control the subcooling.

Next, the flow of the heat medium in the heat medium circuits B will be described.

In the first heating main operation mode, the heat exchanger 25*b* related to heat medium transfers heating energy of the heat source side refrigerant to the heat medium and the pump 31*b* allows the heated heat medium to flow through the pipes 5. Furthermore, in the first heating main operation mode, the heat exchanger 25*a* related to heat medium transfers cooling energy of the heat source side refrigerant to the heat medium, and the pump 31*a* allows the cooled heat medium to flow through the pipes 5. The cooled heat medium that has been pressurized by and flowed out from the pump 31*a* flows into the use side heat exchanger 36 in which a cooling load is generated, via the second heat medium flow switching device 33. The heat medium that has been pressurized by and flowed out from the pump 31*b* flows into the use side heat exchanger 35 in which a heating load is generated, via the second heat medium flow switching device 33.

At this time, when the second heat medium flow switching device 33 is connected to the indoor unit 3 which is in the heating operation mode, the second heat medium flow switching device 33 is switched to the direction to which the heat exchanger 25*b* related to heat medium and the pump 31*b* are connected, and when the second heat medium flow switching device 33 is connected to the indoor unit 3 which is in the cooling operation mode, the second heat medium flow switching device 33 is switched to the direction to which the heat exchanger 25*a* related to heat medium and the pump 31*a* are connected. That is, the heat medium supplied to the indoor unit 3 can be switched to the heating use or cooling use by means of the second heat medium flow switching device 33.

The use side heat exchanger 35 performs a cooling operation of the indoor space 7 as the heat medium removes heat from the indoor air, or a heating operation of the indoor space 7 as the heat medium transfers heat to the indoor air. At this time, each of the heat medium flow control devices 34 controls a flow rate of the heat medium as necessary to cover an air conditioning load required in the indoor space such that the controlled flow rate of the heat medium flows into the corresponding one of the use side heat exchangers 35.

The heat medium, which has passed through the use side heat exchanger 35 with a slight increase of temperature and has been utilized for the cooling operation, passes through the heat medium flow control device 34 and the first heat medium flow switching device 32, flows into the heat exchanger 25*a* related to heat medium, and is suctioned into the pump 31*a* again. The heat medium, which has passed through the use side heat exchanger 35 with a slight decrease of temperature and has been utilized for the heating operation, passes through the heat medium flow control device 34 and the first heat medium flow switching device 32, flows into the heat exchanger 25*b* related to heat medium, and is again suctioned into the pump 31*a*. At this time, when the first heat medium flow switching device 32 is connected to the indoor unit 3 that is in the heating operation mode, the first heat medium flow switching device 32 is switched to the direction to which the heat exchanger 25*b* related to heat medium and the pump 31*b* are connected, and when the first heat medium flow switching device 32 is connected to the indoor unit 3 that is in the cooling operation mode, the first heat medium flow switching device 32 is switched to the direction to which the heat exchanger 25*a* related to heat medium and the pump 31*a* are connected.

During this time, the first heat medium flow switching devices 32 and the second heat medium flow switching devices 33 allow the warm heat medium and the cold heat medium to be introduced into the use side heat exchanger 35 having a heating load and the use side heat exchanger 35 having a cooling load, respectively, without mixing with each other. Accordingly, the heat medium that has been used in the heating operation mode is conveyed to the heat exchanger 25*b* related to heat medium where the refrigerant is transferring heat for heating, and the heat medium that has been used in the cooling operation mode is conveyed to the heat exchanger 25*a* related to heat medium where the refrigerant is receiving heat for cooling, and after each heat medium has exchanged heat with the refrigerant once more, the heat medium is sent to the pump 31*a* and the pump 31*b*.

Note that in the pipes 5 of each use side heat exchanger 35 for heating and that for cooling, the heat medium is directed to flow from the second heat medium flow switching device 33 through the heat medium flow control device 34 to the first heat medium flow switching device 32. Furthermore, the difference between the temperature detected by the temperature sensor 40*b* and the temperature of the heat medium which has flowed out of the use side heat exchanger 35 is controlled such that the difference is held at a target value, so that the air conditioning load required in the indoor space 7 for heating can be covered. The difference between the temperature of the heat medium which has flowed out of the use side heat exchanger 35 and the temperature detected by the temperature sensor 40*a* is controlled such that the difference is held at a target value, so that the air conditioning load required in the indoor space 7 for cooling can be covered.

[Second Heating Main Operation Mode]

Figure 5:
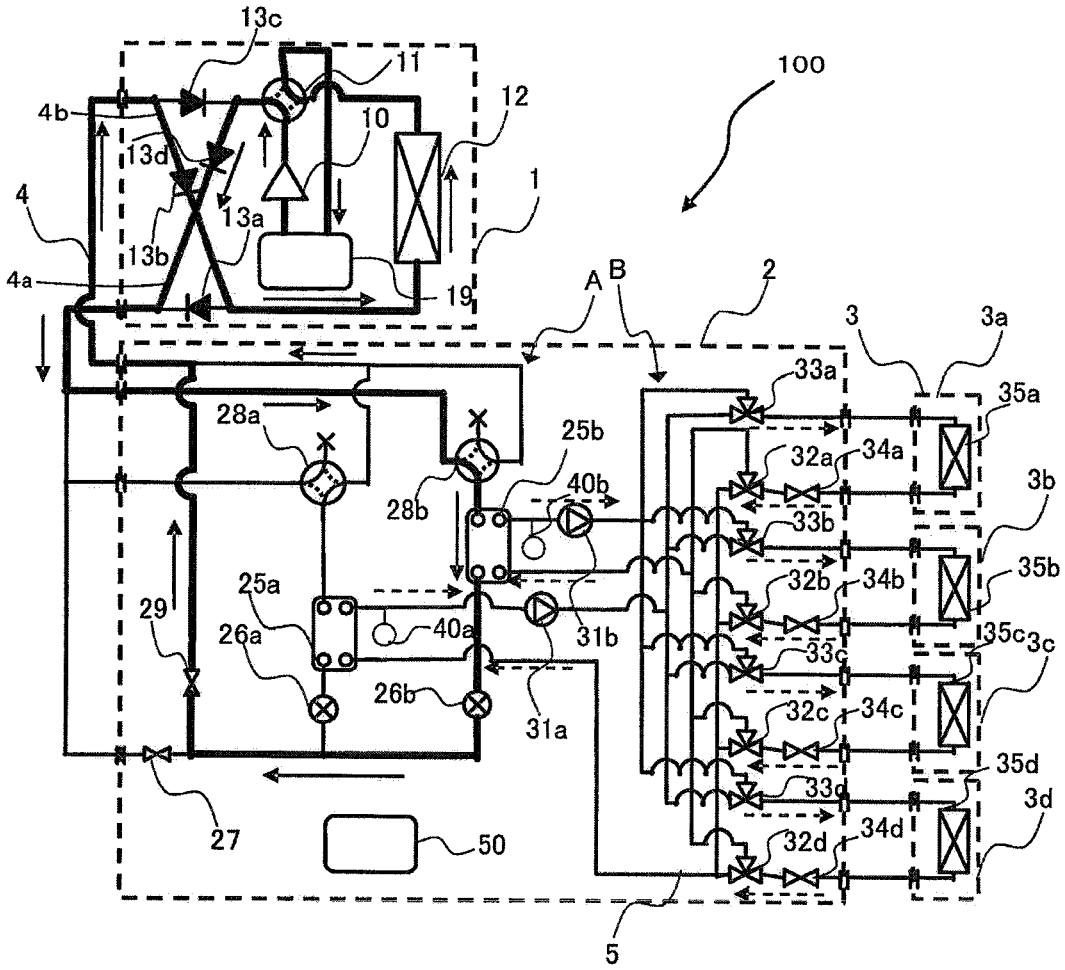
FIG. 5 is a refrigerant circuit diagram illustrating a flow of the refrigerant in a second heating main operation mode of the air-conditioning apparatus according to Embodiment of the invention.

FIG. 5 is a refrigerant circuit diagram illustrating the flow of the refrigerant in the second heating main operation mode of the air-conditioning apparatus 100. In FIG. 5, the first heating main operation mode will be described with respect to a case where a heating load is generated in at least one of the use side heat exchangers 35, and a cooling load is generated in the rest of the use side heat exchangers 35 by way of example. Further, referring to FIG. 5, pipes indicated by thick lines indicate the pipes through which the heat source side refrigerant circulates. Furthermore, referring to FIG. 5, solid-line arrows indicate the flow direction of the heat source side refrigerant and broken-line arrows indicate the flow direction of the heat medium.

During the first heating main operation mode of the air-conditioning apparatus 100, the heat source side heat exchanger 12 in the outdoor unit 1 acts as an evaporator and exchanges heat with the outdoor air. Consequently, when the air-conditioning apparatus executes the first heating main operation mode in a state in which the temperature of the outside air (outside air temperature) is low, the evaporating temperature of the heat source side heat exchanger 12 becomes lower. As a result, in a manner following (dependent on) the evaporating temperature of the heat source side heat exchanger 12, the evaporating temperature of the heat exchanger 25*a* related to heat medium into which a low temperature, low pressure refrigerant is flowing becomes lower. Therefore, in a case where water or a medium with a high freezing temperature is used as the heat medium, there is a possibility that the heat medium may freeze within the heat exchanger 25*a* related to heat medium. In preparation for such a situation, the air-conditioning apparatus 100 has the second heating main operation mode illustrated in FIG. 5 as one of operation modes. The second heating main operation mode is an operation mode for preventing the heat medium from freezing in the heat exchanger 25*a* related to heat medium while the first heating main operation mode is executed (heat medium anti-freezing operation).

In the second heating main operation mode illustrated in FIG. 5, the first refrigerant flow switching device 11 is switched such that the heat source side refrigerant discharged from the compressor 10 flows into the relay unit 2 without passing through the heat source side heat exchanger 12 in the outdoor unit 1. In the relay unit 2, the pump 31*a* and the pump 31*b* are driven, and the heat medium flow control devices 34*a* to 34*d* are opened, so that the heat medium circulates between the heat exchanger 25*a* related to heat medium and the use side heat exchanger 35 in which a cooling load is generated, and between the heat exchanger 25*b* related to heat medium and the use side heat exchanger 35 in which a heating load is generated. The second refrigerant flow switching device 28*a* is switched to the cooling side, the second refrigerant flow switching device 28*b* is switched to the heating side, the expansion device 26*a* is fully closed, the opening and closing device 27 is closed, and the opening and closing device 29 is opened.

First, the flow of the heat source side refrigerant in the refrigerant circuit A will be described.

A low temperature, low pressure refrigerant is compressed by the compressor 10 and is discharged as a high temperature, high pressure gas refrigerant therefrom. The high temperature, high pressure gas refrigerant discharged from the compressor 10 passes through the first refrigerant flow switching device 11, flows through the refrigerant connection pipe 4*a*, passes through the check valve 13*d*, and flows out of the outdoor unit 1. The high temperature, high pressure gas refrigerant that has flowed out of the outdoor unit 1 passes through the refrigerant pipe 4 and flows into the relay unit 2. The high temperature, high pressure gas refrigerant that has flowed into the relay unit 2 passes through the second refrigerant flow switching device 28*b* and flows into the heat exchanger 25*b* related to heat medium functioning as a condenser.

The gas refrigerant that has flowed into the heat exchanger 25*b* related to heat medium is condensed and liquefied while transferring heat to the heat medium circulating in the heat medium circuits B, and turns into a liquid refrigerant. The liquid refrigerant which has flowed from the heat exchanger 25*b* related to heat medium is expanded into a low pressure two-phase refrigerant by the expansion device 26*b*. This low pressure two-phase refrigerant passes through the opening and closing device 29, flows out of the relay unit 2, passes through the refrigerant pipe 4, and again flows into the outdoor unit 1. That is, the expansion device 26*a* is fully closed so that the low temperature, low pressure two-phase refrigerant does not flow into the heat exchanger 25*a* related to heat medium.

The low temperature, low pressure refrigerant that has flowed into the outdoor unit 1 passes through the check valve 13*b* and flows into the heat source side heat exchanger 12 functioning as an evaporator. The refrigerant, which has flowed into the heat source side heat exchanger 12, removes heat from the outdoor air in the heat source side heat exchanger 12, such that it turns into a low temperature, low pressure gas refrigerant. The low temperature, low pressure gas refrigerant which has flowed out of the heat source side heat exchanger 12 passes through the first refrigerant flow switching device 11 and the accumulator 19 and is suctioned into the compressor 10 again.

The opening degree of the expansion device 26*b* is controlled so that the subcooling (degree of subcooling) of the refrigerant in the outlet of the heat exchanger 25*b* related to heat medium becomes a predetermined target value.

Next, the flow of the heat medium in the heat medium circuits B will be described.

In the second heating main operation mode, the heat exchanger 25*b* related to heat medium transfers heating energy of the heat source side refrigerant to the heat medium and the pump 31*b* allows the heated heat medium to flow through the pipes 5. In second heating main operation mode, the heat medium is caused to flow within the pipe 5 by the pump 31*a*, without the heat source side refrigerant and the heat medium exchanging heat in the heat exchanger 25*a* related to heat medium. The heat medium cooled in first heating main operation mode is pressurized by and flows out from the pump 31*a*, flows into the use side heat exchanger 36 in which a cooling load is generated, via the second heat medium flow switching device 33. The heat medium which has been pressurized by and flowed out from the pump 31*b* flows into the use side heat exchanger 35 in which a heating load is generated, via the second heat medium flow switching device 33.

At this time, when the second heat medium flow switching device 33 is connected to the indoor unit 3 which is in the heating operation mode, the second heat medium flow switching device 33 is switched to the direction to which the heat exchanger 25*b* related to heat medium and the pump 31*b* are connected, and when the second heat medium flow switching device 33 is connected to the indoor unit 3 which is in the cooling operation mode, the second heat medium flow switching device 33 is switched to the direction to which the heat exchanger 25*a* related to heat medium and the pump 31*a* are connected. That is, the heat medium supplied to the indoor unit 3 can be switched to the heating use or cooling use depending on the operation mode of the indoor unit 3 by means of the second heat medium flow switching device 33.

The use side heat exchanger 35 performs a cooling operation of the indoor space 7 as the heat medium removes heat from the indoor air, and a heating operation of the indoor space 7 as the heat medium transfers heat to the indoor air. At this time, each of the heat medium flow control devices 34 controls a flow rate of the heat medium as necessary to cover an air conditioning load required in the indoor space such that the controlled flow rate of the heat medium flows into the corresponding one of the use side heat exchangers 35.

The heat medium, which has passed through the use side heat exchanger 35 with a slight increase of temperature and has been utilized for the cooling operation, passes through the heat medium flow control device 34 and the first heat medium flow switching device 32, flows into the heat exchanger 25*a* related to heat medium, and is suctioned into the pump 31*a* again. The heat medium, which has passed through the use side heat exchanger 35 with a slight decrease of temperature and has been utilized for the heating operation, passes through the heat medium flow control device 34 and the first heat medium flow switching device 32, flows into the heat exchanger 25*b* related to heat medium, and is again suctioned into the pump 31*a*. At this time, when the first heat medium flow switching device 32 is connected to the indoor unit 3 that is in the heating operation mode, the first heat medium flow switching device 32 is switched to the direction to which the heat exchanger 25*b* related to heat medium and the pump 31*b* are connected, and when the first heat medium flow switching device 32 is connected to the indoor unit 3 that is in the cooling operation mode, the first heat medium flow switching device 32 is switched to the direction to which the heat exchanger 25*a* related to heat medium and the pump 31*a* are connected.

During this time, the first heat medium flow switching devices 32 and the second heat medium flow switching devices 33 allow the warm heat medium and the cold heat medium to be introduced into the use side heat exchanger 35 having a heating load and the use side heat exchanger 35 having a cooling load, respectively, without mixing with each other. Accordingly, the heat medium that has been used in the heating operation mode is conveyed to the heat exchanger 25*b* related to heat medium where the refrigerant is transferring heat for heating, and the heat medium that has been used in the cooling operation mode is conveyed to the heat exchanger 25*a* related to heat medium where the refrigerant is receiving heat for cooling, and after each heat medium has exchanged heat with the refrigerant once more, the heat medium is sent to the pump 31*a* and the pump 31*b*. Although the heat medium that has been used in the cooling operation mode is caused to flow into the heat exchanger 25*a* related to heat medium, because the refrigerant is prevented from flowing thereinto for preventing freezing of the heat medium, the heat medium is conveyed to the pump 31*a* as it is without exchanging heat with the refrigerant.

While the first heating main operation mode (FIG. 4) is performed, the refrigerant that has become low temperature, low pressure by exchanging heat with the heat medium in the heat exchanger 25*a* related to heat medium and the heat exchanger 25*b* related to heat medium within the relay unit 2 is conveyed to the outdoor unit 1, passes through the check valve 13*b*, and thereafter exchanges heat with the outside air within the heat source side heat exchanger 12. At this time, the refrigerant temperature needs to be lower than the outside air temperature so that the refrigerant flowing within the heat source side heat exchanger 12 exchanges heat with the outside air. Consequently, the refrigerant conveyed out of the relay unit 2 is a low temperature refrigerant having a pressure to which the amount of pressure loss that depends on the length of the refrigerant pipe 4 is added. Likewise, the temperature of the refrigerant passing through the heat exchanger 25*a* related to heat medium is also low.

Figure 6:
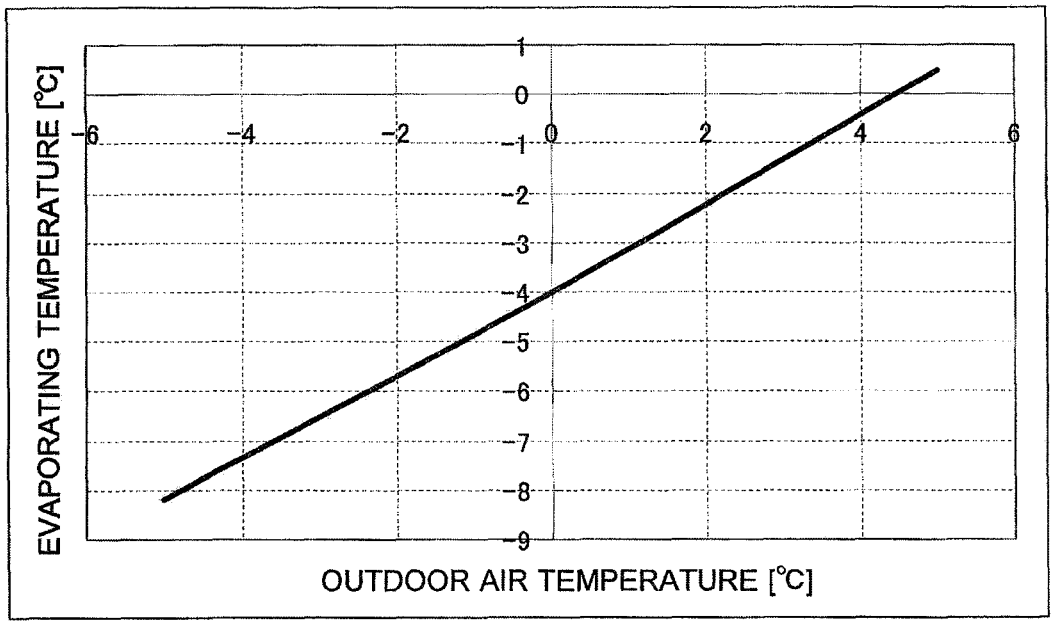
FIG. 6 is a graph illustrating the relationship between the outside air temperature and the evaporating temperature of a heat exchanger related to heat medium.

Therefore, drop or rise of the evaporating temperature of the heat exchanger 25*a* related to heat medium is determined by the outside air temperature. FIG. 6 illustrates the relationship between the outside air temperature (horizontal axis) and the evaporating temperature of the heat exchanger 25*a* related to heat medium (vertical axis). As can be appreciated from FIG. 6, as the outside air temperature drops, the evaporating temperature of the heat exchanger 25*a* related to heat medium also drops. Consequently, when a medium having a high freezing temperature is used as the heat medium, there is a possibility that the heat medium may freeze within the heat exchanger 25*a* related to heat medium.

Figure 7:
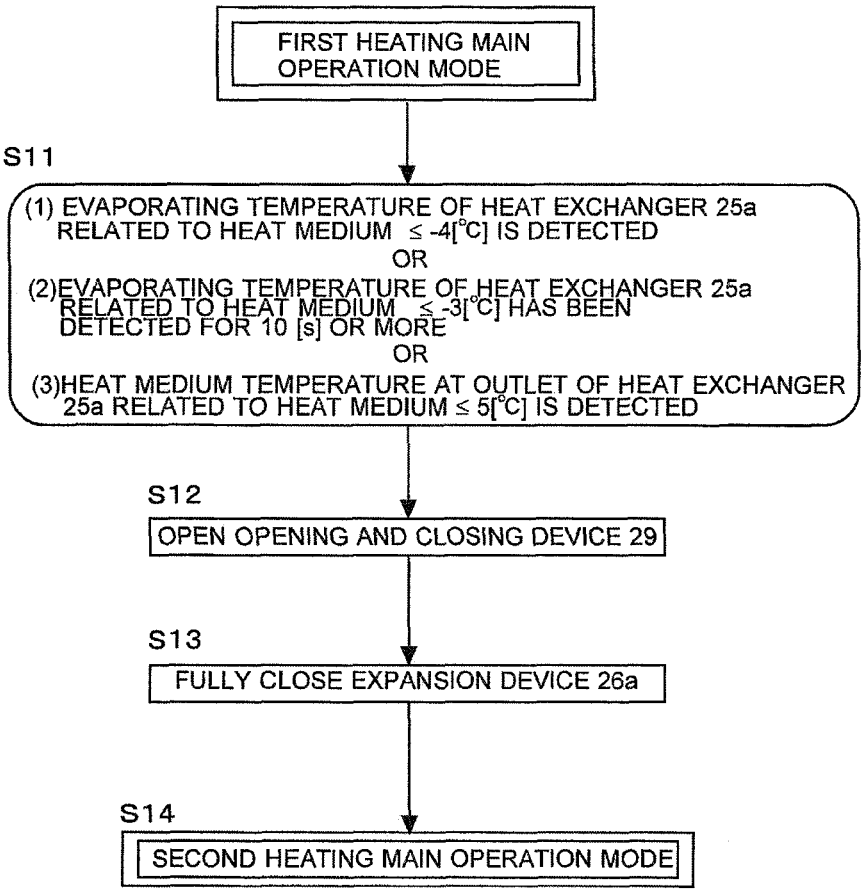
FIG. 7 is a flowchart illustrating the flow of processing performed to prevent freezing of a heat medium in a heat exchanger related to heat medium until the first heating main operation mode transitions to the second heating main operation mode.

FIG. 7 is a flowchart illustrating the flow of processing performed to prevent freezing of the heat medium in the heat exchanger 25*a* related to heat medium until the first heating main operation mode transitions to the second heating main operation mode. With reference to FIG. 7, the flow of processing performed until the first heating main operation mode switches to the second heating main operation mode will be described.

The flowchart of FIG. 7 begins from when the air-conditioning apparatus 100 is executing the first heating main operation mode. When the controller 50 determines that a predetermined condition has been satisfied while the first heating main operation mode is executed, the controller 50 ends the first heating main operation mode, and causes the first heating main operation mode to transition to the second heating main operation mode (step S11). The predetermined condition is, for example, (1) when it is detected that the evaporating temperature of the refrigerant flowing through the heat exchanger 25*a* related to heat medium has become a predetermined temperature (for example, −4 [degrees C] or less) that is set in advance, (2) when a state in which the evaporating temperature of the refrigerant flowing through the heat exchanger 25*a* related to heat medium is a temperature (for example, −3 [degrees C] or less) higher than the temperature that is set in advance in (1) has been detected for a predetermined time (for example, 10 [s] or more), or (3) when it is detected that the temperature of the heat medium that has passed through the heat exchanger 25*a* related to heat medium has become a predetermined temperature (for example, 5 [degrees C] or less) that is set in advance.

Of the above-mentioned conditions for ending the first heating main operation mode, in a case where the detection is made on the basis of the evaporating temperature of the refrigerant flowing through the heat exchanger 25*a* related to heat medium (in the case of the condition (1) or (2) mentioned above), when the temperature of the heat medium that has passed through the heat exchanger 25*a* related to heat medium is not lower than a predetermined temperature (for example, 1 [degree C]), the first heating main operation mode is continued without being ended. That is, in the case of making the determination on the basis of the condition (1) or (2) mentioned above, not only the condition (1) or (2) mentioned above but also the temperature of the heat medium that has passed through the heat exchanger 25*a* related to heat medium is added as a condition, thereby making it possible to determine whether to make a transition from the first heating main operation mode to the second heating main operation mode more appropriately.

When the first heating main operation mode transitions to the second heating main operation mode, the controller 50 first causes the opening and closing device 29 to open to secure a refrigerant passage (step S12). Then, the controller 50 causes the expansion device 26*a* to fully close (step S13). In this way, it is possible to block entry of the refrigerant into the heat exchanger 25*a* related to heat medium, and pass the refrigerant to the opening and closing device 29. An expansion device may be used as the opening and closing device 29. In this case, the refrigerant passage may be secured by fully closing the expansion device 26*a* after setting the opening degree to full opening by the opening control speed of the expansion device, or after securing an opening area equivalent to the opening area of the expansion device 26*a* for a predetermined time. This completes the switching from the first heating main operation mode to the second heating main operation mode.

[First Cooling Only Operation Mode]

Figure 8:
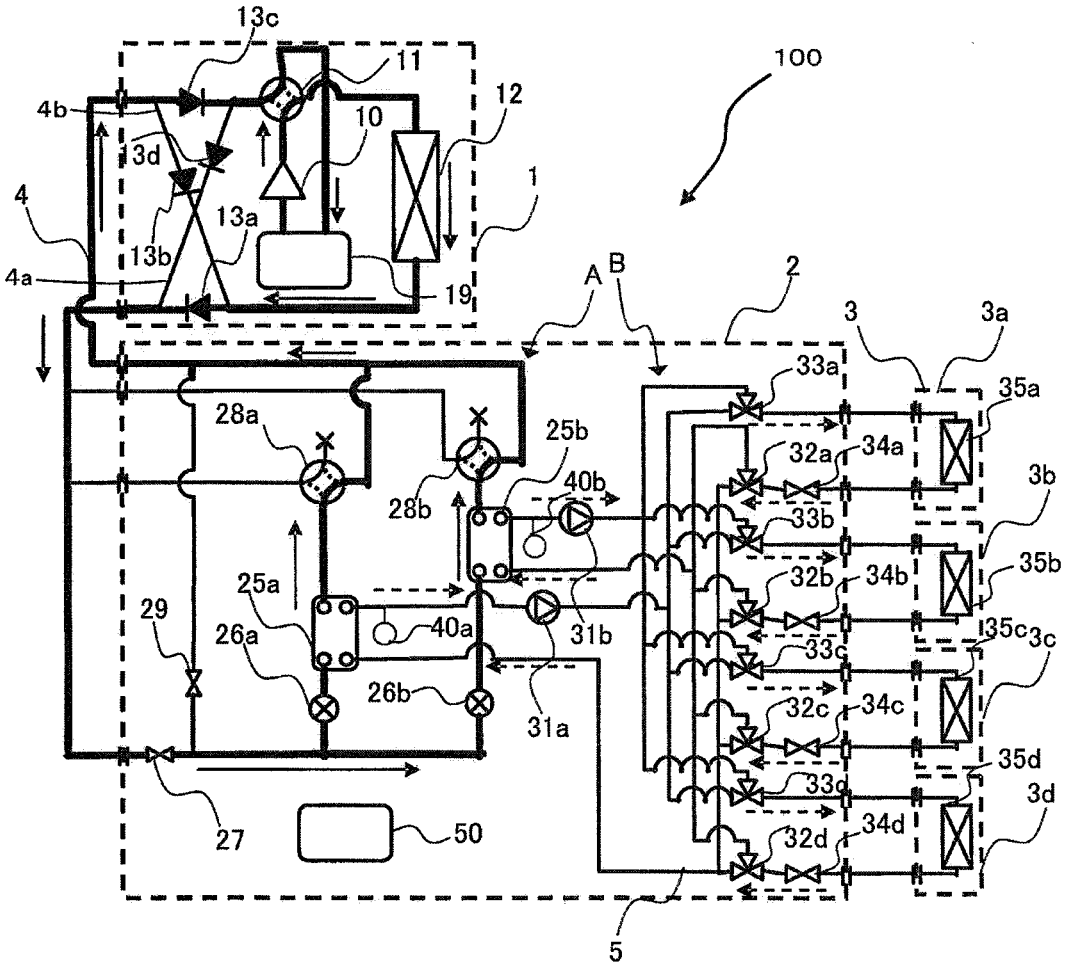
FIG. 8 is a refrigerant circuit diagram illustrating a flow of the refrigerant in a first cooling only operation mode of the air-conditioning apparatus according to Embodiment of the invention.

FIG. 8 is a refrigerant circuit diagram illustrating the flow of the refrigerant in the first cooling only operation mode of the air-conditioning apparatus 100. In FIG. 8, the first heating only operation mode will be described with respect to a case where a cooling load is generated in all of the use side heat exchangers 35*a* to 35*d*. Further, referring to FIG. 8, pipes indicated by thick lines indicate the pipes through which the heat source side refrigerant flows. Furthermore, referring to FIG. 8, solid-line arrows indicate the flow direction of the heat source side refrigerant and broken-line arrows indicate the flow direction of the heat medium.

In the first cooling only operation mode illustrated in FIG. 8, the first refrigerant flow switching device 11 is switched such that the heat source side refrigerant discharged from the compressor 10 flows into the heat source side heat exchanger 12 in the outdoor unit 1. In the relay unit 2, the pump 31*a* and the pump 31*b* are driven, and the heat medium flow control devices 34*a* to 34*d* are opened, so that the heat medium circulates between each of the heat exchanger 25*a* related to heat medium and the heat exchanger 25*b* related to heat medium, and each of the use side heat exchangers 35*a* to 35*d*. The second refrigerant flow switching device 28*a* and the second refrigerant flow switching device 28*b* are switched to the cooling side, the opening and closing device 27 is opened, and the opening and closing device 29 is closed.

First, the flow of the heat source side refrigerant in the refrigerant circuit A will be described.

A low temperature, low pressure refrigerant is compressed by the compressor 10 and is discharged as a high temperature, high pressure gas refrigerant therefrom. The high temperature, high pressure gas refrigerant discharged from the compressor 10 flows through the first refrigerant flow switching device 11 into the heat source side heat exchanger 12. Then, the refrigerant is condensed and liquefied into a high pressure liquid refrigerant while transferring heat to outdoor air in the heat source side heat exchanger 12. The high pressure liquid refrigerant which has flowed out of the heat source side heat exchanger 12 passes through the check valve 13*a*, flows out of the outdoor unit 1, passes through the refrigerant pipe 4, and flows into the relay unit 2. The high pressure liquid refrigerant, which has flowed into the relay unit 2, passes through the opening and closing device 27 and is then divided into flows to the expansion device 26*a* and the expansion device 26*b*, in each of which the refrigerant is expanded into a low temperature, low pressure two-phase refrigerant.

This two-phase refrigerant flows into each of the heat exchanger 25*a* related to heat medium and the heat exchanger 25*b* related to heat medium functioning as an evaporator, removes heat from the heat medium circulating in the heat medium circuits B, cools the heat medium, and turns into a low temperature, low pressure gas refrigerant. The gas refrigerant, which has flowed out of each of the heat exchanger 25*a* related to heat medium and the heat exchanger 25*b* related to heat medium, merges and flows out of the relay unit 2 through the corresponding one of a second refrigerant flow switching device 28*a* and a second refrigerant flow switching device 28*b*, passes through the refrigerant pipe 4, and again flows into the outdoor unit 1. The refrigerant which has flowed into the outdoor unit 1 passes through the check valve 13*c*, the first refrigerant flow switching device 11, and the accumulator 19, and is again suctioned into the compressor 10.

At this time, the opening degree of the expansion device 26 is controlled so that the superheat (degree of superheat) obtained as the difference between the temperature of the heat source side refrigerant flowing into the heat exchanger 25 related to heat medium, and the temperature of the heat source side refrigerant which has flowed out from the heat exchanger 25 related to heat medium becomes constant.

Next, the flow of the heat medium in the heat medium circuits B will be described.

In the first cooling only operation mode, both the heat exchanger 25*a* related to heat medium and the heat exchanger 25*b* related to heat medium transfer cooling energy of the heat source side refrigerant to the heat medium, and the pump 31*a* and the pump 31*b* allow the cooled heat medium to flow through the pipes 5. The heat medium, which has flowed out of each of the pump 31*a* and the pump 31*b* while being pressurized, flows through the second heat medium flow switching devices 33*a* to 33*d* into the use side heat exchangers 35*a* to 35*d*. The heat medium removes heat from the indoor air in each of the use side heat exchangers 35*a* to 35*d*, and thus cools the indoor space 7.

Then, the heat medium flows out of each of the use side heat exchangers 35*a* to 35*b* and flows into the corresponding one of the heat medium flow control devices 34*a* to 34*d*. At this time, each of the heat medium flow control devices 34*a* to 34*d* controls a flow rate of the heat medium as necessary to cover an air conditioning load required in the indoor space such that the controlled flow rate of the heat medium flows into the corresponding one of the use side heat exchangers 35*a* to 35*d*. The heat medium that has flowed out of the heat medium flow control devices 34*a* to 34*d*, passes through the first heat medium flow switching devices 32*a* to 32*d*, flows into the heat exchanger 25*a* related to heat medium and the heat exchanger 25*b* related to heat medium, supplies the quantity of heat amounting to the quantity of heat that had been received from the air in the indoor space 7 through the indoor units 3 to the refrigerant, and is again suctioned into the pump 31*a* and the pump 31*b*.

Note that in the pipes 5 of each use side heat exchanger 35, the heat medium is directed to flow from the second heat medium flow switching device 33 through the heat medium flow control device 34 to the first heat medium flow switching device 32. The air conditioning load required in the indoor space 7 can be provided by controlling the difference between the temperature detected by the temperature sensor 40*a* or the temperature detected by the temperature sensor 40*b* and the temperature of the heat medium that has flowed out of the use side heat exchanger 35 so as to maintain the difference at a target value. As regards a temperature at the outlet of each heat exchanger 25 related to heat medium, either of the temperature detected by the temperature sensor 40*a* or that detected by the temperature sensor 40*b* may be used. Alternatively, the mean temperature of the two may be used.

At this time, the first heat medium flow switching device 32 and the second heat medium flow switching device 33 are controlled to an intermediate opening degree, or an opening degree in accordance with the heat medium temperature at the outlet of the heat exchanger 25*a* related to heat medium and the heat exchanger 25*b* related to heat medium, so as to secure passages leading to both the heat exchanger 25*a* related to heat medium and the heat exchanger 25*b* related to heat medium.

[Second Cooling Only Operation Mode]

Figure 9:
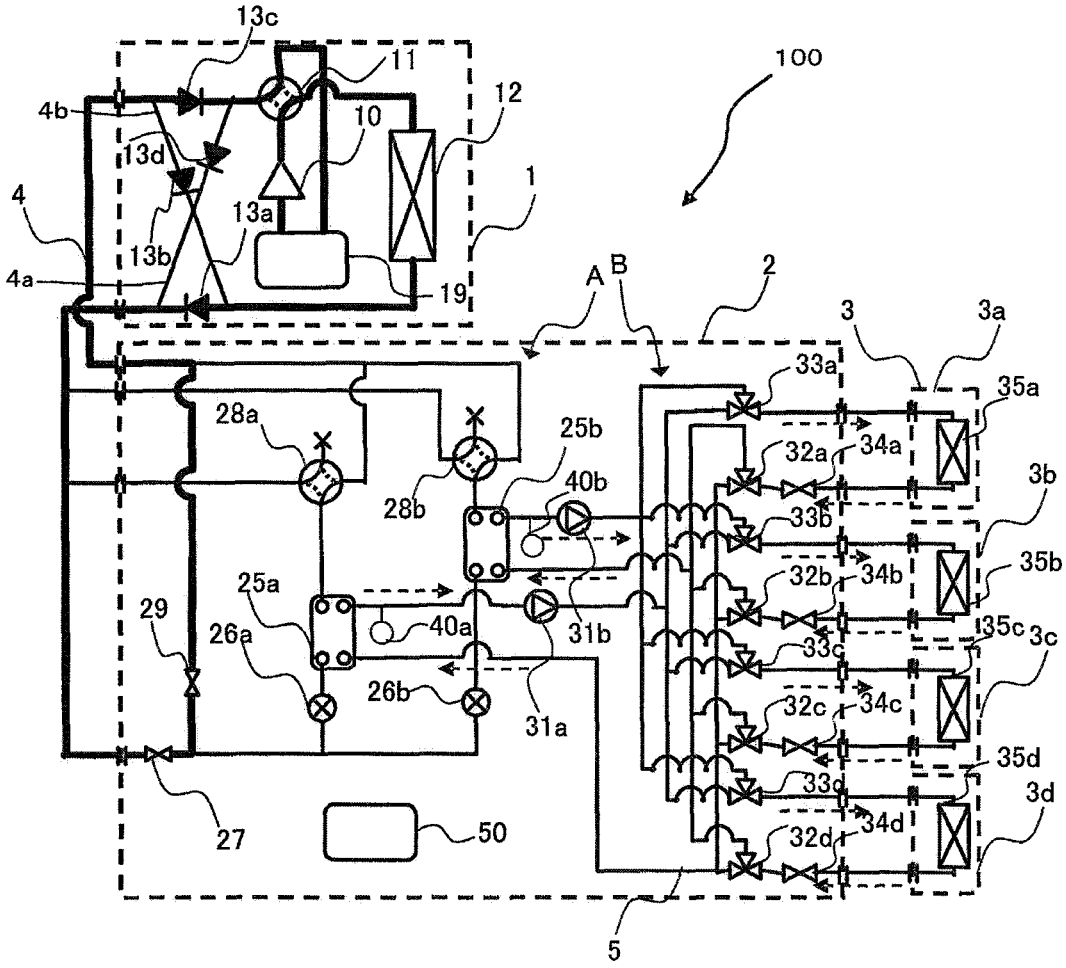
FIG. 9 is a refrigerant circuit diagram illustrating a flow of the refrigerant in a second cooling only operation mode of the air-conditioning apparatus according to Embodiment of the invention.

FIG. 9 is a refrigerant circuit diagram illustrating the flow of the refrigerant in the second cooling only operation mode of the air-conditioning apparatus 100. In FIG. 9, the second cooling only operation mode will be described with respect to a case where a heating load is generated in at least one of the use side heat exchangers 35, and a cooling load is generated in the rest of the use side heat exchangers 35 by way of example. Further, referring to FIG. 9, pipes indicated by thick lines indicate the pipes through which the heat source side refrigerant circulates. Furthermore, referring to FIG. 9, solid-line arrows indicate the flow direction of the heat source side refrigerant and broken-line arrows indicate the flow direction of the heat medium.

While the air-conditioning apparatus 100 is executing the first cooling only operation mode, the heat exchanger 25*a* related to heat medium and the heat exchanger 25*b* related to heat medium within the relay unit 2 each function as an evaporator. Accordingly, there is a possibility that owing to throttling operations by the expansion device 26*a* and the expansion device 26*b*, the temperature of the refrigerant at low temperature, low pressure may further drop transiently. Therefore, in a case where water or a medium with a high freezing temperature is used as the heat medium, there is a possibility that the heat medium may freeze within the heat exchanger 25*a* related to heat medium and the heat exchanger 25*b* related to heat medium. In preparation for such a situation, the air-conditioning apparatus 100 has the second cooling only operation mode illustrated in FIG. 9 as one of operation modes. The second cooling only operation mode is an operation mode for preventing the heat medium from freezing in the heat exchanger 25 related to heat medium while the first cooling only operation mode is executed (heat medium anti-freezing operation).

In the second cooling only operation mode illustrated in FIG. 9, the first refrigerant flow switching device 11 is switched such that the heat source side refrigerant discharged from the compressor 10 flows into the heat source side heat exchanger 12 in the outdoor unit 1. In the relay unit 2, the pump 31*a* and the pump 31*b* are driven, and the heat medium flow control devices 34*a* to 34*d* are opened, so that the heat medium circulates between each of the heat exchanger 25*a* related to heat medium and the heat exchanger 25*b* related to heat medium, and each of the use side heat exchangers 35*a* to 35*d*. The second refrigerant flow switching device 28*a* and the second refrigerant flow switching device 28*b* are switched to the cooling side, the opening and closing device 27 is opened, and the opening and closing device 29 is closed.

First, the flow of the heat source side refrigerant in the refrigerant circuit A will be described.

A low temperature, low pressure refrigerant is compressed by the compressor 10 and is discharged as a high temperature, high pressure gas refrigerant therefrom. The high temperature, high pressure gas refrigerant discharged from the compressor 10 flows through the first refrigerant flow switching device 11 into the heat source side heat exchanger 12. Then, the refrigerant is condensed and liquefied into a high pressure liquid refrigerant while transferring heat to outdoor air in the heat source side heat exchanger 12. The high pressure liquid refrigerant which has flowed out of the heat source side heat exchanger 12 passes through the check valve 13*a*, flows out of the outdoor unit 1, passes through the refrigerant pipe 4, and flows into the relay unit 2. The high pressure liquid refrigerant that has flowed into the relay unit 2 passes through the opening and closing device 29 after passing through the opening and closing device 27 and flows out from the relay unit 2. The refrigerant that has flowed out of the relay unit 2 passes through the refrigerant pipe 4 and flows into the outdoor unit 1 again.

That is, at this time, the expansion device 26*a* and the expansion device 26*b* are fully closed so that the refrigerant conveyed from the outdoor unit 1 does not flow into the heat exchanger 25*a* related to heat medium and the heat exchanger 25*b* related to heat medium. Then, the refrigerant which has flowed into the outdoor unit 1 passes through the check valve 13*c*, the first refrigerant flow switching device 11, and the accumulator 19, and is again suctioned into the compressor 10.

Next, the flow of the heat medium in the heat medium circuits B will be described.

In the second cooling only operation mode, the heat source side refrigerant flows into neither the heat exchanger 25*a* related to heat medium nor the heat exchanger 25*b* related to heat medium. Accordingly, the heat medium that has been cooled in first cooling only operation mode is caused to flow within the pipe 5 by the pump 31*a* and the pump 31*b*, without exchanging heat with the refrigerant. The heat medium, which has flowed out of each of the pump 31*a* and the pump 31*b* while being pressurized, flows through the second heat medium flow switching devices 33*a* to 33*d* into the use side heat exchangers 35*a* to 35*d*. The heat medium removes heat from the indoor air in each of the use side heat exchangers 35*a* to 35*d*, and thus cools the indoor space 7.

Then, the heat medium flows out of each of the use side heat exchangers 35*a* to 35*b* and flows into the corresponding one of the heat medium flow control devices 34*a* to 34*d*. At this time, each of the heat medium flow control devices 34*a* to 34*d* controls a flow rate of the heat medium as necessary to cover an air conditioning load required in the indoor space such that the controlled flow rate of the heat medium flows into the corresponding one of the use side heat exchangers 35*a* to 35*d*. The heat medium that has flowed out from the heat medium flow control devices 34*a* to 34*d* passes through the first heat medium flow switching devices 32*a* to 32*d*, flows into the heat exchanger 25*a* related to heat medium and the heat exchanger 25*b* related to heat medium, and is suctioned into the pump 31*a* and the pump 31*b* again while retaining the quantity of heat received from the indoor space 7 through the indoor unit 3.

Note that in the pipes 5 of each use side heat exchanger 35, the heat medium is directed to flow from the second heat medium flow switching device 33 through the heat medium flow control device 34 to the first heat medium flow switching device 32. The air conditioning load required in the indoor space 7 can be provided by controlling the difference between the temperature detected by the temperature sensor 40*a* or the temperature detected by the temperature sensor 40*b* and the temperature of the heat medium that has flowed out of the use side heat exchanger 35 so as to maintain the difference at a target value. As regards a temperature at the outlet of each heat exchanger 25 related to heat medium, either of the temperature detected by the temperature sensor 40*a* or that detected by the temperature sensor 40*b* may be used. Alternatively, the mean temperature of the two may be used.

At this time, the first heat medium flow switching device 32 and the second heat medium flow switching device 33 are controlled to an intermediate opening degree, or an opening degree in accordance with the heat medium temperature at the outlet of the heat exchanger 25*a* related to heat medium and the heat exchanger 25*b* related to heat medium, so as to secure passages leading to both the heat exchanger 25*a* related to heat medium and the heat exchanger 25*b* related to heat medium.

Figure 10:
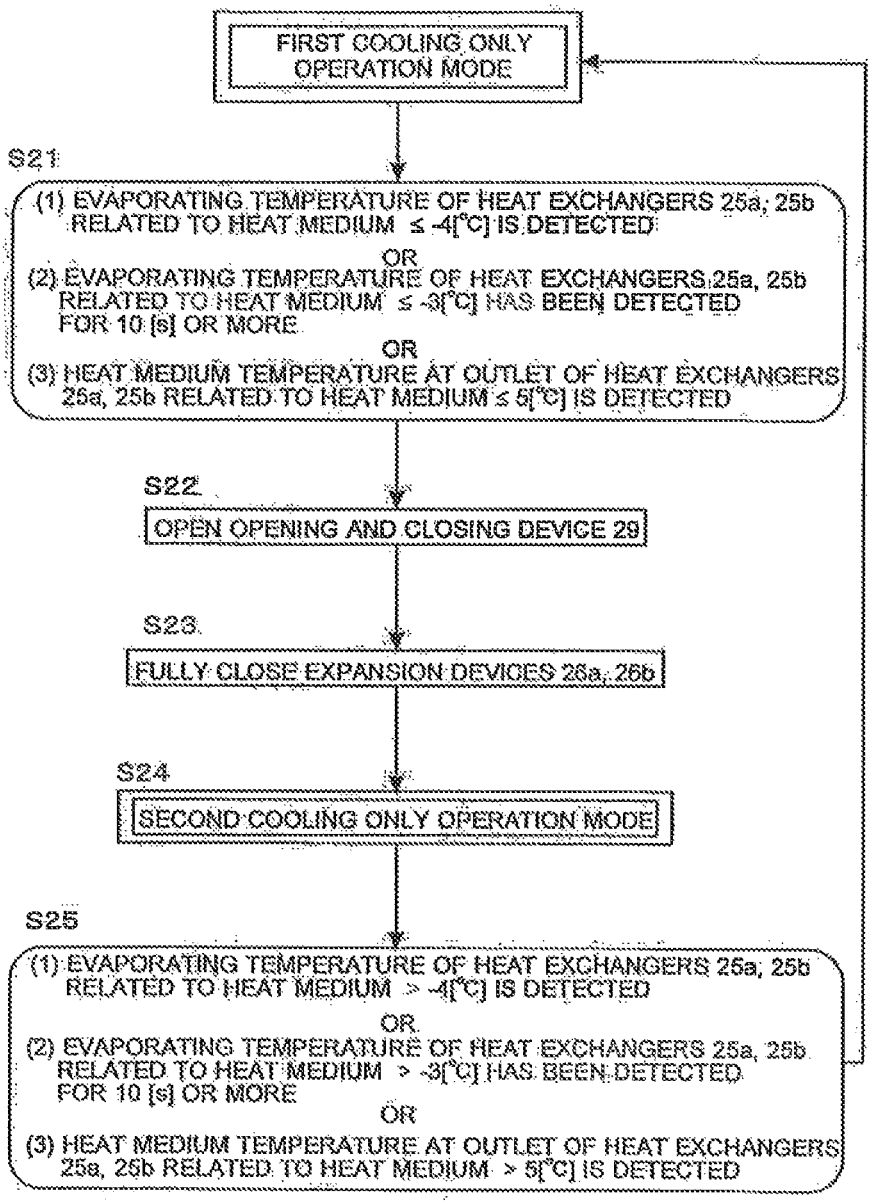
FIG. 10 is a flowchart illustrating the flow of processing performed to prevent freezing of the heat medium in heat exchangers related to heat medium until the first cooling only operation mode transitions to the second cooling only operation mode.

FIG. 10 is a flowchart illustrating the flow of processing performed to prevent freezing of the heat medium in the heat exchanger 25*a* related to heat medium and the heat exchanger 25*b* related to heat medium until the first cooling only operation mode transitions to the second cooling only operation mode. With reference to FIG. 10, the flow of processing performed until the first cooling only operation mode switches to the second cooling only operation mode will be described.

While the first cooling only operation mode (FIG. 8) is executed, there is a possibility that owing to throttling operations by the expansion device 26*a* and the expansion device 26*b*, the temperature of the refrigerant at low temperature, low pressure may further drop transiently. Then, the evaporating temperature of the heat exchanger 25*a* related to heat medium and the heat exchanger 25*b* related to heat medium within the relay unit 2 drops, and when a medium with a high freezing temperature is used as the heat medium, there is a possibility that the heat medium may freeze within the heat exchanger 25*a* related to heat medium and the heat exchanger 25*b* related to heat medium.

The flowchart of FIG. 10 begins from when the air-conditioning apparatus 100 is executing the first cooling only operation mode. When the controller 50 determines that a predetermined condition has been satisfied while the first cooling only operation mode is executed, the controller 50 ends the first cooling only operation mode, and causes the first cooling only operation mode to transition to the second cooling only operation mode (step S21). The predetermined condition is, for example, (1) when it is detected that the evaporating temperature of the refrigerant flowing through the heat exchanger 25*a* related to heat medium and the heat exchanger 25*b* related to heat medium has become a predetermined temperature (for example, −4 [degrees C] or less) that is set in advance, (2) when a state in which the evaporating temperature of the refrigerant flowing through the heat exchanger 25*a* related to heat medium and the heat exchanger 25*b* related to heat medium is a temperature (for example, −3 [degrees C] or less) higher than the temperature that is set in advance in (1) has been detected for a predetermined time (for example, 10 [s] or more), or (3) when it is detected that the temperature of the heat medium that has passed through the heat exchanger 25*a* related to heat medium and the heat exchanger 25*b* related to heat medium has become a predetermined temperature (for example, 5 [degrees C] or less) that is set in advance.

Of the above-mentioned conditions for ending the first cooling only operation mode, in a case where the detection is made on the basis of the evaporating temperature of the refrigerant flowing through the heat exchanger 25*a* related to heat medium and the heat exchanger 25*b* related to heat medium (in the case of the condition (1) or (2) mentioned above), when the temperature of the heat medium that has passed through the heat exchanger 25*a* related to heat medium and the heat exchanger 25*b* related to heat medium is not lower than a predetermined temperature (for example, 1 [degree C]), the first cooling only operation mode is continued without being ended. That is, in the case of making the determination on the basis of the condition (1) or (2) mentioned above, not only the condition (1) or (2) mentioned above but also the temperature of the heat medium that has passed through the heat exchanger 25*a* related to heat medium and the heat exchanger 25*b* related to heat medium is added as a condition, thereby making it possible to determine whether to make a transition from the first cooling only operation mode to the second cooling only operation mode more appropriately.

When the first cooling only operation mode transitions to the second cooling only operation mode, the controller 50 first causes the opening and closing device 29 to open to secure a refrigerant passage (step S22). Then, the controller 50 causes the expansion device 26*a* and the expansion device 26*b* to fully close (step S23). In this way, it is possible to block entry of the refrigerant into the heat exchanger 25*a* related to heat medium and the heat exchanger 25*b* related to heat medium, and pass the refrigerant to the opening and closing device 29. An expansion device may be used as the opening and closing device 29. In this case, the refrigerant passage may be secured by fully closing the expansion device 26*a* and the expansion device 26*b* after setting the opening degree to full opening by the opening control speed of the expansion device, or after securing an opening area equivalent to the opening area of the expansion device 26*a* and the expansion device 26*b* for a predetermined time. This completes the switching from the first cooling only operation mode to the second cooling only operation mode (step S24).

When the air-conditioning apparatus 100 is executing the second cooling only operation mode, the conditions for switching from the first cooling only operation mode to the second cooling only operation mode are periodically tried to be detected, and if those conditions are not satisfied even once (step S25), the processing returns to the first cooling only operation mode. The operation procedure at this time may be carried out in a manner reverse to that when switching from the first cooling only operation mode to the second cooling only operation mode.

[First Cooling Main Operation Mode]

Figure 11:
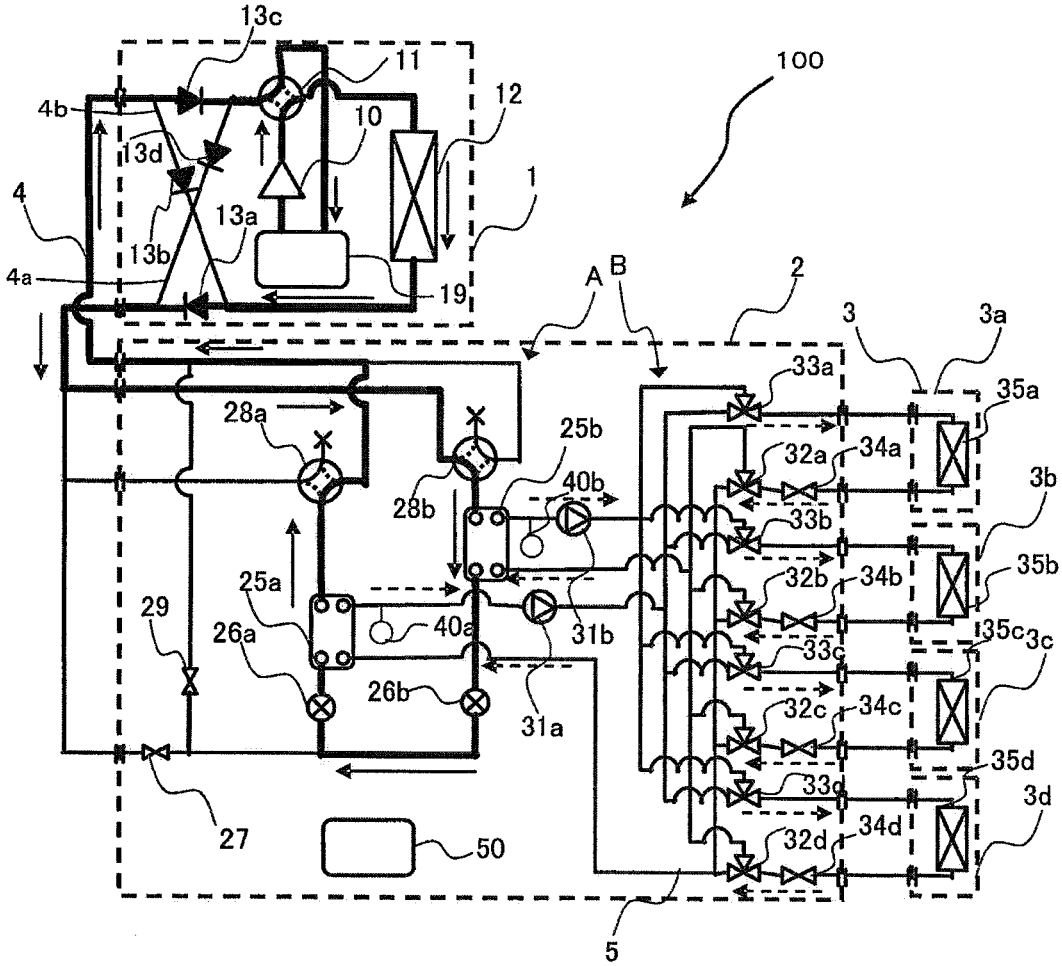
FIG. 11 is a refrigerant circuit diagram illustrating a flow of the refrigerant in a first cooling main operation mode of the air-conditioning apparatus according to Embodiment of the invention.

FIG. 11 is a refrigerant circuit diagram illustrating the flow of the refrigerant in the first cooling main operation mode of the air-conditioning apparatus 100. In FIG. 11, the first cooling main operation mode will be described with respect to a case where a cooling load is generated in at least one of the use side heat exchangers 35, and a heating load is generated in the rest of the use side heat exchangers 35 by way of example. Further, referring to FIG. 11, pipes indicated by thick lines indicate the pipes through which the heat source side refrigerant circulates. Furthermore, referring to FIG. 11, solid-line arrows indicate the flow direction of the heat source side refrigerant and broken-line arrows indicate the flow direction of the heat medium.

In the first cooling main operation mode illustrated in FIG. 11, the first refrigerant flow switching device 11 is switched such that the heat source side refrigerant discharged from the compressor 10 flows into the heat source side heat exchanger 12 in the outdoor unit 1. In the relay unit 2, the pump 31*a* and the pump 31*b* are driven, and the heat medium flow control devices 34*a* to 34*d* are opened, so that the heat medium circulates between the heat exchanger 25*a* related to heat medium and the use side heat exchanger 35 in which a cooling load is generated, and between the heat exchanger 25*b* related to heat medium and the use side heat exchanger 35 in which a heating load is generated. The second refrigerant flow switching device 28*a* is switched to the cooling side, the second refrigerant flow switching device 28*b* is switched to the heating side, the expansion device 26*a* is fully opened, the opening and closing device 27 is closed, and the opening and closing device 29 is closed.

First, the flow of the heat source side refrigerant in the refrigerant circuit A will be described.

A low temperature, low pressure refrigerant is compressed by the compressor 10 and is discharged as a high temperature, high pressure gas refrigerant therefrom. The high temperature, high pressure gas refrigerant discharged from the compressor 10 flows through the first refrigerant flow switching device 11 into the heat source side heat exchanger 12. The refrigerant is condensed into a two-phase refrigerant in the heat source side heat exchanger 12 while transferring heat to the outside air. The two-phase refrigerant which has flowed out of the heat source side heat exchanger 12 passes through the check valve 13*a*, flows out of the outdoor unit 1, passes through the refrigerant pipe 4, and flows into the relay unit 2. The two-phase refrigerant, which has flowed into the relay unit 2, passes through the second refrigerant flow switching device 28*b* and flows into the heat exchanger 25*b* related to heat medium, functioning as a condenser.

The two-phase refrigerant that has flowed into the heat exchanger 25*b* related to heat medium is condensed and liquefied while transferring heat to the heat medium circulating in the heat medium circuits B, and turns into a liquid refrigerant. The refrigerant which has flowed from the heat exchanger 25*b* related to heat medium is expanded into a low pressure two-phase refrigerant by the expansion device 26*b*. This low pressure two-phase refrigerant flows through the expansion device 26*a* and into the heat exchanger 25*a* related to heat medium functioning as an evaporator. The low pressure two-phase refrigerant, which has flowed into the heat exchanger 25*a* related to heat medium, removes heat from the heat medium circulating in the heat medium circuits B to cool the heat medium, and thus turns into a low pressure gas refrigerant. This gas refrigerant flows out of the heat exchanger 25*a* related to heat medium, passes through the second refrigerant flow switching device 28*a*, flows out of the relay unit 2, passes through the refrigerant pipe 4, and again flows into the outdoor unit 1. The heat source side refrigerant which has flowed into the outdoor unit 1 passes through the check valve 13*c*, the first refrigerant flow switching device 11, and the accumulator 19, and is again suctioned into the compressor 10.

The opening degree of the expansion device 26*b* is controlled so that the superheat (degree of superheat) of the refrigerant in the outlet of the heat exchanger 25*b* related to heat medium becomes a predetermined target value. Alternatively, the expansion device 26*b* may be fully opened and the expansion device 26*a* may control the superheat.

Next, the flow of the heat medium in the heat medium circuits B will be described.

In the first cooling main operation mode, the heat exchanger 25*b* related to heat medium transfers heating energy of the heat source side refrigerant to the heat medium and the pump 31*b* allows the heated heat medium to flow through the pipes 5. Furthermore, in the first cooling main operation mode, the heat exchanger 25*a* related to heat medium transfers cooling energy of the heat source side refrigerant to the heat medium, and the pump 31*a* allows the cooled heat medium to flow through the pipes 5. The heat medium, which has flowed out of each of the pump 31*a* and the pump 31*b* while being pressurized, flows through the second heat medium flow switching device 33*a* and the second heat medium flow switching device 33*b* into the use side heat exchanger 35*a* and the use side heat exchanger 35*b*.

At this time, when the second heat medium flow switching device 33 is connected to the indoor unit 3 which is in the heating operation mode, the second heat medium flow switching device 33 is switched to the direction to which the heat exchanger 25*b* related to heat medium and the pump 31*b* are connected, and when the second heat medium flow switching device 33 is connected to the indoor unit 3 which is in the cooling operation mode, the second heat medium flow switching device 33 is switched to the direction to which the heat exchanger 25*a* related to heat medium and the pump 31*a* are connected. That is, the heat medium supplied to the indoor unit 3 can be switched to the heating use or cooling use by means of the second heat medium flow switching device 33.

The use side heat exchanger 35 performs a heating operation of the indoor space 7 as the heat medium transfers heat to the indoor air, or a cooling operation of the indoor space 7 as the heat medium removes heat from the indoor air. At this time, each of the heat medium flow control devices 34 controls a flow rate of the heat medium as necessary to cover an air conditioning load required in the indoor space such that the controlled flow rate of the heat medium flows into the corresponding one of the use side heat exchangers 35.

The heat medium, which has passed through the use side heat exchanger 35 with a slight decrease of temperature and has been utilized for the heating operation, passes through the heat medium flow control device 34 and the first heat medium flow switching device 32, flows into the heat exchanger 25*b* related to heat medium, and is again suctioned into the pump 31*b*. The heat medium, which has passed through the use side heat exchanger 35 with a slight increase of temperature and has been utilized for the cooling operation, passes through the heat medium flow control device 34 and the first heat medium flow switching device 32, flows into the heat exchanger 25*a* related to heat medium, and is suctioned into the pump 31*a* again. At this time, when the first heat medium flow switching device 32 is connected to the indoor unit 3 that is in the heating operation mode, the first heat medium flow switching device 32 is switched to the direction to which the heat exchanger 25*b* related to heat medium and the pump 31*b* are connected, and when the first heat medium flow switching device 32 is connected to the indoor unit 3 that is in the cooling operation mode, the first heat medium flow switching device 32 is switched to the direction to which the heat exchanger 25*a* related to heat medium and the pump 31*a* are connected.

During this time, the first heat medium flow switching devices 32 and the second heat medium flow switching devices 33 allow the warm heat medium and the cold heat medium to be introduced into the use side heat exchanger 35 having a heating load and the use side heat exchanger 35 having a cooling load, respectively, without mixing with each other. Accordingly, the heat medium that has been used in the heating operation mode is conveyed to the heat exchanger 25*b* related to heat medium where the refrigerant is transferring heat for heating, and the heat medium that has been used in the cooling operation mode is conveyed to the heat exchanger 25*a* related to heat medium where the refrigerant is receiving heat for cooling, and after each heat medium has exchanged heat with the refrigerant once more, the heat medium is sent to the pump 31*a* and the pump 31*b*.

Note that in the pipes 5 of each use side heat exchanger 35 for heating and that for cooling, the heat medium is directed to flow from the second heat medium flow switching device 33 through the heat medium flow control device 34 to the first heat medium flow switching device 32. Furthermore, the difference between the temperature detected by the temperature sensor 40*b* and the temperature of the heat medium which has flowed out of the use side heat exchanger 35 is controlled such that the difference is held at a target value, so that the air conditioning load required in the indoor space 7 for heating can be covered. The difference between the temperature of the heat medium which has flowed out of the use side heat exchanger 35 and the temperature detected by the temperature sensor 40*a* is controlled such that the difference is held at a target value, so that the air conditioning load required in the indoor space 7 for cooling can be covered.

[Second Cooling Main Operation Mode]

Figure 12:
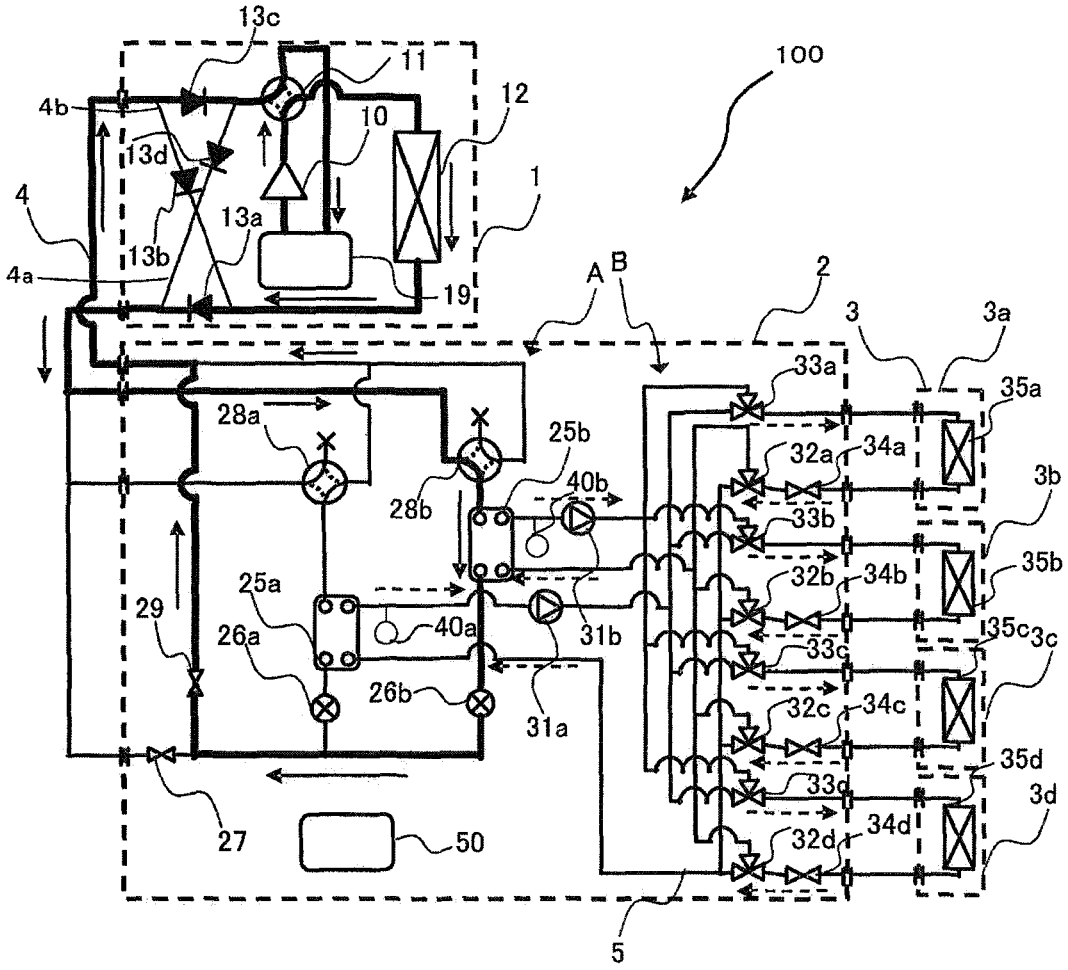
FIG. 12 is a refrigerant circuit diagram illustrating a flow of the refrigerant in a second cooling main operation mode of the air-conditioning apparatus according to Embodiment of the invention.

FIG. 12 is a refrigerant circuit diagram illustrating the flow of the refrigerant in the second cooling main operation mode of the air-conditioning apparatus 100. In FIG. 12, the second cooling main operation mode will be described with respect to a case where a heating load is generated in at least one of the use side heat exchangers 35, and a cooling load is generated in the rest of the use side heat exchangers 35 by way of example. Further, referring to FIG. 12, pipes indicated by thick lines indicate the pipes through which the heat source side refrigerant circulates. Furthermore, referring to FIG. 12, solid-line arrows indicate the flow direction of the heat source side refrigerant and broken-line arrows indicate the flow direction of the heat medium.

While the air-conditioning apparatus 100 is executing the first cooling main operation mode, the heat exchanger 25*a* related to heat medium within the relay unit 2 functions as an evaporator. Accordingly, there is a possibility that owing to a throttling operation by the expansion device 26*a*, the temperature of the refrigerant at low temperature, low pressure may further drop transiently. Therefore, in a case where water or a medium with a high freezing temperature is used as the heat medium, there is a possibility that the heat medium may freeze within the heat exchanger 25*a* related to heat medium. In preparation for such a situation, the air-conditioning apparatus 100 has the second cooling main operation mode illustrated in FIG. 12 as one of operation modes. The second cooling main operation mode is an operation mode for preventing the heat medium from freezing in the heat exchanger 25 related to heat medium while the first cooling main operation mode is executed (heat medium anti-freezing operation).

In the second cooling main operation mode illustrated in FIG. 12, the first refrigerant flow switching device 11 is switched such that the heat source side refrigerant discharged from the compressor 10 flows into the heat source side heat exchanger 12 in the outdoor unit 1. In the relay unit 2, the pump 31*a* and the pump 31*b* are driven, and the heat medium flow control devices 34*a* to 34*d* are opened, so that the heat medium circulates between the heat exchanger 25*a* related to heat medium and the use side heat exchanger 35 in which a cooling load is generated, and between the heat exchanger 25*b* related to heat medium and the use side heat exchanger 35 in which a heating load is generated. The second refrigerant flow switching device 28*a* is switched to the cooling side, the second refrigerant flow switching device 28*b* is switched to the heating side, the expansion device 26*a* is fully closed, the opening and closing device 27 is closed, and the opening and closing device 29 is opened.

First, the flow of the heat source side refrigerant in the refrigerant circuit A will be described.

A low temperature, low pressure refrigerant is compressed by the compressor 10 and is discharged as a high temperature, high pressure gas refrigerant therefrom. The high temperature, high pressure gas refrigerant discharged from the compressor 10 flows through the first refrigerant flow switching device 11 into the heat source side heat exchanger 12. The refrigerant is condensed into a two-phase refrigerant in the heat source side heat exchanger 12 while transferring heat to the outside air. The two-phase refrigerant which has flowed out of the heat source side heat exchanger 12 passes through the check valve 13*a*, flows out of the outdoor unit 1, passes through the refrigerant pipe 4, and flows into the relay unit 2. The two-phase refrigerant, which has flowed into the relay unit 2, passes through the second refrigerant flow switching device 28*b* and flows into the heat exchanger 25*b* related to heat medium, functioning as a condenser.

The two-phase refrigerant that has flowed into the heat exchanger 25*b* related to heat medium is condensed and liquefied while transferring heat to the heat medium circulating in the heat medium circuits B, and turns into a liquid refrigerant. The refrigerant which has flowed from the heat exchanger 25*b* related to heat medium is expanded into a low pressure two-phase refrigerant by the expansion device 26*b*. This low pressure two-phase refrigerant passes through the opening and closing device 29, flows out of the relay unit 2, passes through the refrigerant pipe 4, and again flows into the outdoor unit 1. That is, the expansion device 26*a* is fully closed so that the low temperature, low pressure two-phase refrigerant does not flow into the heat exchanger 25*a* related to heat medium. The low temperature, low pressure two-phase refrigerant which has flowed into the outdoor unit 1 passes through the check valve 13*c*, the first refrigerant flow switching device 11, and the accumulator 19, and is again suctioned into the compressor 10.

The opening degree of the expansion device 26*b* is controlled so that the subcooling (degree of subcooling) of the refrigerant in the outlet of the heat exchanger 25*b* related to heat medium becomes a predetermined target value.

Next, the flow of the heat medium in the heat medium circuits B will be described.

In the second cooling main operation mode, the heat exchanger 25*b* related to heat medium transfers heating energy of the heat source side refrigerant to the heat medium and the pump 31*b* allows the heated heat medium to flow through the pipes 5. In second heating main operation mode, the heat medium is caused to flow within the pipe 5 by the pump 31*a*, without the heat source side refrigerant and the heat medium exchanging heat in the heat exchanger 25*a* related to heat medium. The heat medium cooled in first cooling main operation mode is pressurized by and flows out from the pump 31*a*, flows into the use side heat exchanger 36 in which a cooling load is generated, via the second heat medium flow switching device 33. The heat medium which has been pressurized by and flowed out from the pump 31*b* flows into the use side heat exchanger 35 in which a heating load is generated, via the second heat medium flow switching device 33.

At this time, when the second heat medium flow switching device 33 is connected to the indoor unit 3 that is in the heating operation mode, the second heat medium flow switching device 33 is switched to the direction to which the heat exchanger 25*b* related to heat medium and the pump 31*b* are connected, and when the second heat medium flow switching device 33 is connected to the indoor unit 3 that is in the cooling operation mode, the second heat medium flow switching device 33 is switched to the direction to which the heat exchanger 25*a* related to heat medium and the pump 31*a* are connected. That is, the heat medium supplied to the indoor unit 3 can be switched to the heating use or cooling use depending on the operation mode of the indoor unit 3 by means of the second heat medium flow switching device 33.

The use side heat exchanger 35 performs a cooling operation of the indoor space 7 as the heat medium removes heat from the indoor air, and a heating operation of the indoor space 7 as the heat medium transfers heat to the indoor air. At this time, each of the heat medium flow control devices 34 controls a flow rate of the heat medium as necessary to cover an air conditioning load required in the indoor space such that the controlled flow rate of the heat medium flows into the corresponding one of the use side heat exchangers 35.

The heat medium, which has passed through the use side heat exchanger 35 with a slight increase of temperature and has been utilized for the cooling operation, passes through the heat medium flow control device 34 and the first heat medium flow switching device 32, flows into the heat exchanger 25*a* related to heat medium, and is suctioned into the pump 31*a* again. The heat medium, which has passed through the use side heat exchanger 35 with a slight decrease of temperature and has been utilized for the heating operation, passes through the heat medium flow control device 34 and the first heat medium flow switching device 32, flows into the heat exchanger 25*b* related to heat medium, and is again suctioned into the pump 31*a*. At this time, when the first heat medium flow switching device 32 is connected to the indoor unit 3 that is in the heating operation mode, the first heat medium flow switching device 32 is switched to the direction to which the heat exchanger 25*b* related to heat medium and the pump 31*b* are connected, and when the first heat medium flow switching device 32 is connected to the indoor unit 3 that is in the cooling operation mode, the first heat medium flow switching device 32 is switched to the direction to which the heat exchanger 25*a* related to heat medium and the pump 31*a* are connected.

During this time, the first heat medium flow switching devices 32 and the second heat medium flow switching devices 33 allow the warm heat medium and the cold heat medium to be introduced into the use side heat exchanger 35 having a heating load and the use side heat exchanger 35 having a cooling load, respectively, without mixing with each other. Accordingly, the heat medium that has been used in the heating operation mode is conveyed to the heat exchanger 25*b* related to heat medium where the refrigerant is transferring heat for heating, and the heat medium that has been used in the cooling operation mode is conveyed to the heat exchanger 25*a* related to heat medium where the refrigerant is receiving heat for cooling, and after each heat medium has exchanged heat with the refrigerant once more, the heat medium is sent to the pump 31*a* and the pump 31*b*. Although the heat medium that has been used in the cooling operation mode is caused to flow into the heat exchanger 25*a* related to heat medium, because the refrigerant is prevented from flowing thereinto for preventing freezing of the heat medium, the heat medium is conveyed to the pump 31*a* as it is without exchanging heat with the refrigerant.

Figure 13:
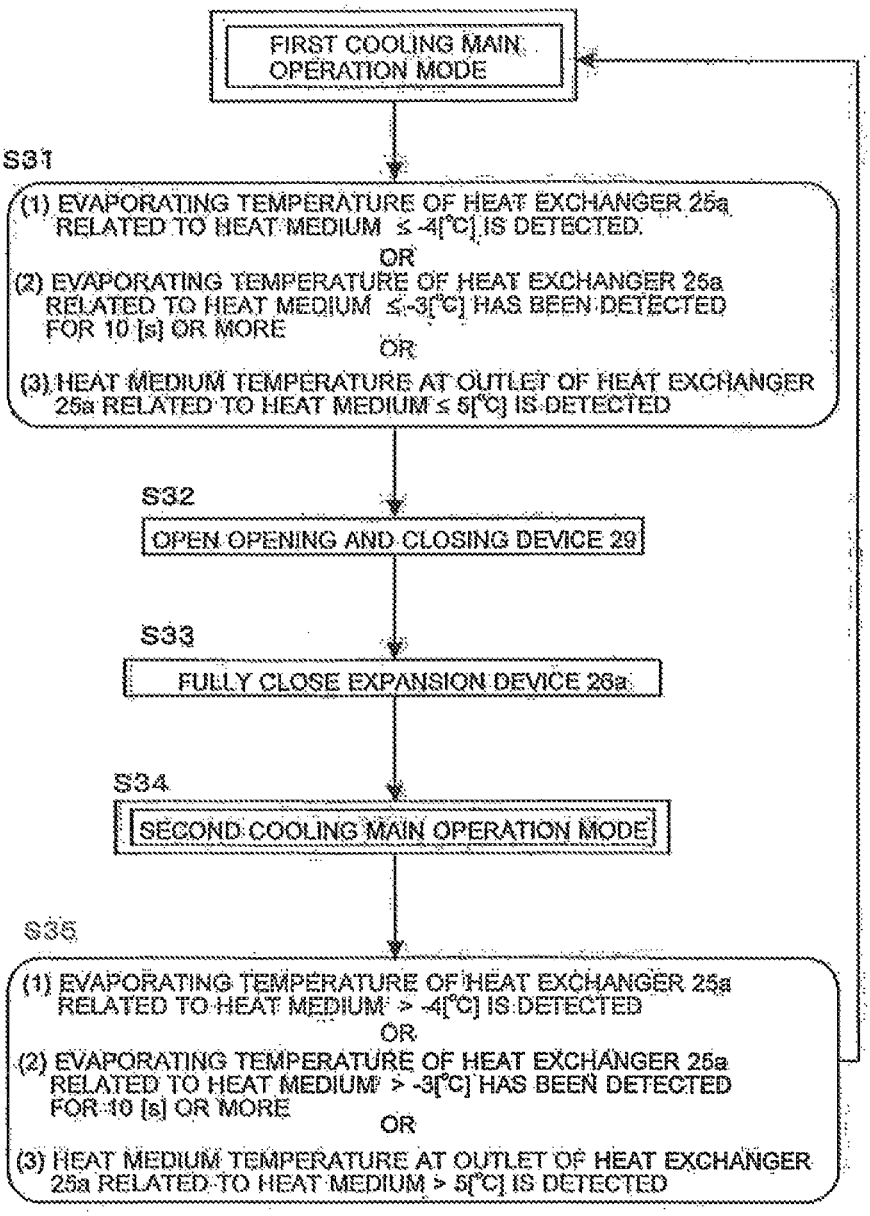
FIG. 13 is a flowchart illustrating the flow of processing performed to prevent freezing of the heat medium in the heat exchanger related to heat medium until the first cooling main operation mode transitions to the second cooling main operation mode.

FIG. 13 is a flowchart illustrating the flow of processing performed to prevent freezing of the heat medium in the heat exchanger 25*a* related to heat medium until the first cooling main operation mode transitions to the second cooling main operation mode. With reference to FIG. 13, the flow of processing performed until the first cooling main operation mode switches to the second cooling main operation mode will be described.

While the first cooling main operation mode (FIG. 11) is executed, there is a possibility that owing to a throttling operation by the expansion device 26*a*, the temperature of the refrigerant at low temperature, low pressure may further drop transiently. Then, the evaporating temperature of the heat exchanger 25*a* related to heat medium within the relay unit 2 drops, and when a medium with a high freezing temperature is used as the heat medium, there is a possibility that the heat medium may freeze within the heat exchanger 25*a* related to heat medium.

The flowchart of FIG. 13 begins from when the air-conditioning apparatus 100 is executing the first cooling main operation mode. When the controller 50 determines that a predetermined condition has been satisfied while the first cooling main operation mode is executed, the controller 50 ends the first cooling main operation mode, and causes the first cooling main operation mode to transition to the second cooling main operation mode (step S31). The predetermined condition is, for example, (1) when it is detected that the evaporating temperature of the refrigerant flowing through the heat exchanger 25*a* related to heat medium has become a predetermined temperature (for example, −4 [degrees C] or less) that is set in advance, (2) when a state in which the evaporating temperature of the refrigerant flowing through the heat exchanger 25*a* related to heat medium is a temperature (for example, −3 [degrees C] or less) higher than the temperature that is set in advance in (1) has been detected for a predetermined time (for example, 10 [s] or more), or (3) when it is detected that the temperature of the heat medium that has passed through the heat exchanger 25*a* related to heat medium has become a predetermined temperature (for example, 5 [degrees C] or less) that is set in advance.

Of the above-mentioned conditions for ending the first cooling main operation mode, in a case where the detection is made on the basis of the evaporating temperature of the refrigerant flowing through the heat exchanger 25*a* related to heat medium, when the temperature of the heat medium that has passed through the heat exchanger 25*a* related to heat medium is not lower than a predetermined temperature (for example, 1 [degree C]), the first cooling main operation mode is continued without being ended. That is, not only the condition (1) or (2) mentioned above but also the temperature of the heat medium that has passed through the heat exchanger 25*a* related to heat medium is added as a condition, thereby making it possible to determine whether to make a transition from the first cooling main operation mode to the second cooling main operation mode more appropriately.

When the first cooling main operation mode transitions to the second cooling main operation mode, the controller 50 first causes the opening and closing device 29 to open to secure a refrigerant passage (step S32). Then, the controller 50 causes the expansion device 26*a* to fully close (step S33). In this way, it is possible to block entry of the refrigerant into the heat exchanger 25*a* related to heat medium, and pass the refrigerant to the opening and closing device 29. An expansion device may be used as the opening and closing device 29. In this case, the refrigerant passage may be secured by fully closing the expansion device 26*a* after setting the opening degree to full opening by the opening control speed of the expansion device, or after securing an opening area equivalent to the opening area of the expansion device 26*a* for a predetermined time. This completes the switching from the first cooling main operation mode to the second cooling main operation mode (step S34).

When the air-conditioning apparatus 100 is executing the second cooling main operation mode, the conditions for switching from the first cooling main operation mode to the second cooling main operation mode are periodically tried to be detected, and if those conditions are not satisfied even once (step S35), the processing returns to the first cooling main operation mode. The operation procedure at this time may be carried out in a manner reverse to that when switching from the first cooling main operation mode to the second cooling main operation mode.

[Refrigerant Pipes 4]

As described above, the air-conditioning apparatus 100 according to Embodiment has several operation modes. In these operation modes, the heat source side refrigerant flows through the refrigerant pipes 4 connecting the outdoor unit 1 and the relay unit 2.

[Pipes 5]

In some operation modes executed by the air-conditioning apparatus 100 according to Embodiment, the heat medium, such as water or antifreeze, flows through the pipes 5 connecting the relay unit 2 and the indoor units 3.

Furthermore, in the air-conditioning apparatus 100, in the case in which only the heating load or cooling load is generated in the use side heat exchangers 35, the corresponding first heat medium flow switching devices 32 and the corresponding second heat medium flow switching devices 33 are controlled so as to have a medium opening degree, such that the heat medium flows into both of the heat exchanger 25*a* related to heat medium and the heat exchanger 25*b* related to heat medium. Consequently, since both of the heat exchanger 25*a* related to heat medium and the heat exchanger 25*b* related to heat medium can be used for the heating operation or the cooling operation, the heat transfer area is increased, so that the heating operation or the cooling operation can efficiently be performed.

In addition, in the case where the heating load and the cooling load are simultaneously generated in the use side heat exchangers 35, the first heat medium flow switching device 32 and the second heat medium flow switching device 33 corresponding to the use side heat exchanger 35 which performs the heating operation are switched to the passage connected to the heat exchanger 25*b* related to heat medium for heating, and the first heat medium flow switching device 32 and the second heat medium flow switching device 33 corresponding to the use side heat exchanger 35 which performs the cooling operation are switched to the passage connected to the heat exchanger 25*a* related to heat medium for cooling, so that the heating operation or cooling operation can be freely performed in each indoor unit 3.

Furthermore, each of the first heat medium flow switching devices 32 and the second heat medium flow switching devices 33 described in Embodiment may be any component which can switch passages, for example, a three-way valve capable of switching between flow directions in a three-way passage, or two two-way valves, such as on-off valves opening or closing a two-way passage used in combination. Alternatively, as each of the first heat medium flow switching devices 32 and the second heat medium flow switching devices 33, for example, a stepping-motor-driven mixing valve, capable of changing a flow rate in a three-way passage may be used, or, two electronic expansion valves, capable of changing a flow rate in a two-way passage may be used in combination. In this case, water hammer caused when a passage is suddenly opened or closed can be prevented. Furthermore, while Embodiment has been described with respect to the case where each of the heat medium flow control devices 34 is a two-way valve, each of the heat medium flow control devices 34 may be a control valve having a three-way passage and the valve may be disposed with a bypass pipe that bypasses the corresponding use side heat exchanger 35.

Furthermore, each of the heat medium flow control devices 34 may be a two-way valve or a three-way valve whose one end is closed as long as it is capable of controlling a flow rate in a passage in a stepping-motor-driven manner. Alternatively, each of the heat medium flow control devices 34 may be an on-off valve and the like, opening or closing a two-way passage such that the average flow rate is controlled while ON and OFF operations are repeated.

Furthermore, while each second refrigerant flow switching device 28 is described as a four-way valve, the device is not limited to this type. A plurality of two-way or three-way flow switching valves may be used such that the refrigerant flows in the same way.

In addition, it is needless to say that the same holds true for the case where one use side heat exchanger 35 and one heat medium flow control device 34 are connected. Moreover, obviously, there is no problem if a plurality of components acting in the same way are arranged as the heat exchangers 25 related to heat medium and the expansion devices 26. Furthermore, while the case where the heat medium flow control devices 34 are arranged in the relay unit 2 has been described, the arrangement is not limited to this case. Each heat medium flow control device 34 may be disposed in the indoor unit 3. The relay unit 2 may be separated from the indoor unit 3.

As the heat medium, for example, brine (antifreeze), water, a mixed solution of brine and water, or a mixed solution of water and an additive with high anticorrosive effect can be used. Therefore, in the air-conditioning apparatus 100, even if the heat medium leaks to the indoor space 7 via the indoor unit 3, the use of a highly safe heat medium contributes to improvement of safety.

While Embodiment has been described with respect to the case in which the air-conditioning apparatus 100 includes the accumulator 19, the accumulator 19 may be omitted. Typically, each of the heat source side heat exchanger 12 and the use side heat exchangers 35 is provided with an air-sending device and in many cases, air sending facilitates condensation or evaporation. However, the structure is not limited to this case. For example, a panel heater and the like, taking advantage of radiation can be used as the use side heat exchanger 35 and a water-cooled heat exchanger which transfers heat using water or antifreeze can be used as the heat source side heat exchanger 12. In other words, as long as the heat exchanger is configured to be capable of transferring heat or removing heat, any type of heat exchanger can be used as each of the heat source side heat exchanger 12 and the use side heat exchanger 35.

Embodiment has been described in which the number of the use side heat exchangers 35 is four. As a matter of course, the arrangement is not limited to this case. In addition, while Embodiment has been described with respect to the case where the number of the heat exchanger 25*a* related to heat medium and the heat exchanger 25*b* related to heat medium is two, obviously, the arrangement is not limited to this case. As long as each heat exchanger 25 related to heat medium is configured to be capable of cooling and/or heating the heat medium, the number of heat exchangers 25 related to heat medium arranged is not limited. Furthermore, each of the number of pumps 31*a* and that of pumps 31*b* is not limited to one. A plurality of pumps having a small capacity may be connected in parallel.

As described above, the air-conditioning apparatus 100 according to Embodiment not only improves safety by not circulating the heat source side refrigerant to the indoor unit 3 or the vicinity of the indoor unit 3, but also can execute a highly safe operation by efficiently preventing freezing of the heat medium, thereby improving energy efficiency with reliability. Additionally, the air-conditioning apparatus 100 can save energy because the pipes 5 can be made shorter. Moreover, the air-conditioning apparatus 100 includes a reduced number of pipes (the refrigerant pipes 4, the pipes 5) connecting the outdoor unit 1 and the relay unit 2 or connecting the relay unit 2 and the indoor unit 3 to make the installation easier.

REFERENCE SIGNS LIST

1 outdoor unit, 2 relay unit, 3 indoor unit, 3*a* indoor unit, 3*b* indoor unit, 3*c* indoor unit, 3*d* indoor unit, 4 refrigerant pipe, 4*a* refrigerant connection pipe, 4*b* refrigerant connection pipe, 5 pipe, 6 outdoor space, 7 indoor space, 8 space, 9 structure, 10 compressor, 11 first refrigerant flow switching device, 12 heat source side heat exchanger, 13*a* check valve, 13*b* check valve, 13*c* check valve, 13*d* check valve, 19 accumulator, 20 bypass pipe, 25 heat exchanger related to heat medium, 25*a* heat exchanger related to heat medium, 25*b* heat exchanger related to heat medium, 26 expansion device, 26*a* expansion device, 26*b* expansion device, 27 opening and closing device, 28 second refrigerant flow switching device, 28*a* second refrigerant flow switching device, 28*b* second refrigerant flow switching device, 29 opening and closing device, 31 pump, 31*a* pump, 31*b* pump, 32 first heat medium flow switching device, 32*a* first heat medium flow switching device, 32*b* first heat medium flow switching device, 32*c* first heat medium flow switching device, 32*d* first heat medium flow switching device, 33 second heat medium flow switching device, 33*a* second heat medium flow switching device, 33*b* second heat med flow switching device, 33*c* second heat medium flow switching device, 33*d* second heat medium flow switching device, 34 heat medium flow control device, 34*a* heat medium flow control device, 34*b* heat medium flow control device, 34*c* heat medium flow control device, 34*d* heat medium flow control device, 35 use side heat exchanger, 35*a* use side heat exchanger, 35*b* use side heat exchanger, 35*c* use side heat exchanger, 35*d* use side heat exchanger, 36 use side heat exchanger, 40 temperature sensor, 40*a* temperature sensor, 40*b* temperature sensor, 50 controller, 100 air-conditioning apparatus, A refrigerant circuit, B heat medium circuit.

The invention claimed is:

1. An air-conditioning apparatus comprising:

a refrigerant circuit that connects a compressor, a first refrigerant flow switching valve, a plurality of second refrigerant flow switching valves, refrigerant passage of a plurality of heat exchangers related to a heat medium, a plurality of expansion valves and a heat source side heat exchanger by a refrigerant pipe;

a first opening and closing valve provided to the refrigerant pipe;

a second opening and closing valve provided to the refrigerant pipe;

a heat medium circuit that connects a pump, a plurality of use side heat exchangers and heat medium passage of the plurality of heat exchangers related to the heat medium by a heat medium pipe;

a plurality of temperature sensors, each of which is configured to detect an evaporating temperature of refrigerant flowing through a corresponding one of the plurality of heat exchangers related to the heat medium; and a controller configured to control the compressor, the first refrigerant flow switching valve, the plurality of second refrigerant flow switching valves, the pump, the first opening and closing valve and the second opening and closing valve based on the evaporating temperatures detected by the plurality of temperature sensors, wherein the refrigerant pipe includes a first pipe having a one end and an other end, the first pipe bypasses the plurality of heat exchangers related to heat medium and is provided with the second opening and closing valve, a second pipe having a one end connected to the first refrigerant flow switching valve or the heat source side heat exchanger and other ends each connected to corresponding one of the plurality of second refrigerant flow switching valves, a third pipe having a one end connected to the heat source side heat exchanger or the first refrigerant flow switching valve and other ends each connected to corresponding one of the plurality of expansion valves, the third pipe being provided with the first opening and closing valve, and a plurality of fourth pipes each having a one end connected to the third pipe at a position upstream of the first opening and closing valve, and an other end connected to corresponding one of the plurality of second refrigerant flow switching valves, wherein the one end of the first pipe is connected to the second pipe, and the other end of the first pipe is connected to the third pipe at a position between the first opening and closing valve and the plurality of expansion valves, wherein each of the plurality of second refrigerant flow switching valves, corresponding one of the plurality of heat exchangers related to heat medium, and corresponding one of the plurality of expansion valves are connected in series, wherein the first refrigerant flow switching valve is configured to selectively form a first path in which a discharge side of the compressor is fluidly connected to the one end of the third pipe and a suction side of the compressor is fluidly connected to the heat source side heat exchanger, and a second path in which the discharge side of the compressor is fluidly connected to the heat source side heat exchanger and the suction side of the compressor is fluidly connected to the one end of the second pipe, wherein each of the plurality of second refrigerant flow switching valves is configured to selectively form a third path in which the other end of corresponding one of the plurality of fourth pipes is fluidly connected to corresponding one of the plurality of heat exchangers related to the heat medium, and a fourth path in which corresponding one of the other ends of the second pipe is fluidly connected to corresponding one of the plurality of heat exchangers related to the heat medium, wherein the controller is configured to perform a heating only operation in which the controller controls the first refrigerant flow switching valve to form the first path, the plurality of second refrigerant flow switching valves to form the third path, the first opening and closing valve to be closed, and the second opening and closing valve to be opened, wherein in the heating only operation, the plurality of heat exchangers related to heat medium function as radiators, a cooling only operation in which the controller controls the first refrigerant flow switching valve to form the second path, the plurality of second refrigerant flow switching valves to form the fourth path, the first opening and closing valve to be opened, and the second opening and closing valve to be closed, wherein in the cooling only operation, the plurality of heat exchangers related to heat medium function as evaporators, a cooling and heating mixed operation in which the controller controls the first refrigerant flow switching valve to form the first path or the second path, one or more of the plurality of second refrigerant flow switching valves to form the third path, remaining one or more of the plurality of second refrigerant flow switching valves to form the fourth path, the first opening and closing valve and the second opening and closing valve to be closed, wherein in the cooling and heating mixed operation, the one or more of the plurality of heat exchangers related to heat medium functions as a radiator, and the remaining one or more of the plurality of heat exchangers related to heat medium functions as an evaporator, a first heat medium antifreeze operation in which the controller controls the first refrigerant flow switching valve to form the second path, the plurality of second refrigerant flow switching valves to form the fourth path, the first opening and closing valve to be opened, the second opening and closing valve to be opened, and the plurality of expansion valves to be closed, and a second heat medium antifreeze operation in which the controller controls the first refrigerant flow switching valve to form the first path or the second path, one or more of the plurality of second refrigerant flow switching valves to form the third path, remaining one or more of the plurality of second refrigerant flow switching valves to form the fourth path, the first opening and closing valve to be closed, the second opening and closing valve to be opened, and one or more of the plurality of expansion valves connected to the one or more of the plurality of second refrigerant flow switching valves forming the third path to be closed, wherein the controller is configured to start the first heat medium antifreeze operation in a case where the evaporating temperature detected by one of the plurality of temperature sensors is equal to or lower than a first predetermined temperature when the cooling only operation is performed, and start the second heat medium antifreeze operation in a case where the evaporating temperature detected by one of the plurality of temperature sensors is equal to or lower than a second predetermined temperature when the cooling and heating mixed operation is performed.

2. The air-conditioning apparatus of claim 1, wherein in a case where the evaporating temperature of the heat source side refrigerant in one or more of the plurality of heat exchangers related to the heat medium that functions as the evaporator is dependent on an evaporating temperature of the heat source side heat exchanger, and the evaporating temperature of the heat source side refrigerant is determined by an outside air temperature, the first heat medium anti-freezing operation and the second heat medium anti-freezing operation are executed during a heating main operation of the cooling and heating operation mixed operation in which a heating load is greater than a cooling load.

3. The air-conditioning apparatus of claim 1, wherein in a case where the evaporating temperature of the heat source side refrigerant in one or more of the plurality of heat exchangers related to the heat medium that functions as the evaporator is lowered by throttling operations by the expansion valve, the first heat medium anti-freezing operation and the second heat medium anti-freezing operation are executed during the cooling only operation, or an operation of a cooling main operation of the cooling and heating operation mixed operation in which a cooling load is greater than a heating load.

4. The air-conditioning apparatus of claim 1, wherein:

the compressor and the heat source side heat exchanger are accommodated in an outdoor unit;

the plurality of heat exchangers related to the heat medium, the expansion valves, and the pump are accommodated in a relay unit;

the use side heat exchanger is accommodated in an indoor unit; and the outdoor unit, the relay unit, and the indoor unit are configured as separate components.

5. The air-conditioning apparatus of claim 1, wherein the controller is configured to start the first heat medium antifreeze operation in a case where the evaporating temperature detected by one of the plurality of temperature sensors is equal to or lower than the first predetermined temperature for a first period when the cooling only operation is performed, and start the second heat medium antifreeze operation in a case where the evaporating temperature detected by one of the plurality of temperature sensors is equal to or lower than the second predetermined temperature for a second period when the cooling and heating mixed operation is performed.

6. The air-conditioning apparatus of claim 1, wherein the controller is configured to activate the pump during the first heat medium antifreeze operation and the second heat medium antifreeze operation.

* * * * *